US012295482B2

(12) United States Patent
Porter

(10) Patent No.: US 12,295,482 B2
(45) Date of Patent: May 13, 2025

(54) MODULAR WEARABLE TECH GEAR SYSTEM

(71) Applicant: CHVD Justin LLC, Cleveland, OH (US)

(72) Inventor: Chad J. Porter, Cleveland, OH (US)

(73) Assignee: CHVD Justin LLC, Cleveland, OH (US)

( * ) Notice: Subject to any disclaimer, the term of this patent is extended or adjusted under 35 U.S.C. 154(b) by 0 days.

(21) Appl. No.: 18/805,039

(22) Filed: Aug. 14, 2024

(65) Prior Publication Data

US 2024/0415267 A1 Dec. 19, 2024

Related U.S. Application Data

(63) Continuation of application No. 17/300,326, filed on Dec. 29, 2022, which is a continuation of application (Continued)

(51) Int. Cl.

*A45F 3/04* (2006.01)
*A45F 3/00* (2006.01)

(Continued)

(52) U.S. Cl.

CPC ..... *A45F 3/04* (2013.01); *A45F 3/005* (2013.01); *A45F 3/02* (2013.01); *A45C 11/002* (2025.01);

(Continued)

(58) Field of Classification Search

CPC ..... A45F 2004/023

(Continued)

(56) References Cited

U.S. PATENT DOCUMENTS

D232,273 S 7/1974 Ross
D240,566 S 7/1976 Westerberg (Continued)

FOREIGN PATENT DOCUMENTS

CN 205696362 U 11/2016
DE 3033237 A1 4/1982

(Continued)

OTHER PUBLICATIONS

Youtube.com/watch?v=L2LeDcz0v3E, posted on Aug. 24, 2019. (Year: 2019).*

(Continued)

*Primary Examiner* — Scott T McNurlen
(74) *Attorney, Agent, or Firm* — McNees Wallace & Nurick LLC

(57) ABSTRACT

In one embodiment, a modular wearable system includes a backpack including a backpack body and backpack fasteners on backpack straps extending from the backpack body, a handbag including a handbag body and handbag fasteners on handbag straps and a handle extending from the handbag body, and a vest including a vest body and vest fasteners on vest straps extending from the vest body. The backpack fasteners reversibly couple to the handbag fasteners to form a wearable combination. The handbag fasteners couple to the vest fasteners to form another wearable combination. In another embodiment, a modular wearable system includes a backpack a handbag, and a shoulder bag strap including a pair of shoulder bag strap fasteners. The backpack fasteners reversibly couple to the handbag fasteners to form a wearable combination. The shoulder bag fasteners reversible couple to a pair of the handbag fasteners to form another wearable combination.

18 Claims, 39 Drawing Sheets

Related U.S. Application Data

No. 29/708,028, filed on Oct. 2, 2019, now Pat. No. Des. 1,062,208, application No. 18/805,039, filed on Aug. 14, 2024 is a continuation of application No. 18/614,621, filed on Mar. 22, 2024, now abandoned, which is a continuation of application No. 17/300,326, filed on Dec. 29, 2022, and a continuation of application No. 29/708,028, filed on Oct. 2, 2019, now Pat. No. Des. 1,062,208, application No. 18/805,039, filed on Aug. 14, 2024 is a continuation of application No. 29/934,123, filed on Mar. 22, 2024.

(51) Int. Cl.
*A45F 3/02* (2006.01)
*A45C 11/00* (2006.01)
*A45F 4/02* (2006.01)

(52) U.S. Cl.
CPC ..... *A45C 11/003* (2025.01); *A45F 2004/023* (2013.01)

(58) Field of Classification Search
USPC ..... 224/682, 604–605, 631, 646–647, 224/578–583
See application file for complete search history.

(56) References Cited

U.S. PATENT DOCUMENTS

| | | | | |
|---|---|---|---|---|
| D258,098 | S | 2/1981 | Norinsky | |
| D291,262 | S | 8/1987 | Colby | |
| D292,847 | S | 11/1987 | Barker | |
| 5,799,851 | A | 9/1998 | Wulf et al. | |
| 6,216,932 | B1 * | 4/2001 | Wu | A45F 3/04 224/583 |
| 6,431,424 | B1 * | 8/2002 | Smith | A45F 3/14 224/675 |
| D500,590 | S | 1/2005 | Sachen | |
| D544,708 | S | 6/2007 | Barker | |
| D605,849 | S | 12/2009 | Mori | |
| D660,585 | S | 5/2012 | McDonald et al. | |
| D686,818 | S * | 7/2013 | Shepherd | D3/217 |
| D692,653 | S | 11/2013 | Platt et al. | |
| D702,434 | S | 4/2014 | Chalk et al. | |
| 8,820,596 | B1 | 9/2014 | Bergquist | |
| 8,919,628 | B2 * | 12/2014 | Jamlang | A45F 3/10 224/583 |
| D752,860 | S | 4/2016 | Barilaro et al. | |
| D874,134 | S | 2/2020 | Savoulidis | |
| D953,736 | S | 6/2022 | Mckinney et al. | |
| 2005/0011108 | A1 * | 1/2005 | Noraker | A01K 97/06 43/54.1 |
| 2014/0239030 | A1 * | 8/2014 | Roth | A45F 3/10 224/633 |

FOREIGN PATENT DOCUMENTS

| | | | | |
|---|---|---|---|---|
| FR | 2834186 | A1 | 7/2003 | |
| IE | S990015 | A2 * | 9/2000 | |
| KR | 200424282 | Y1 | 8/2006 | |
| WO | WO-2004100706 | A1 * | 11/2004 | A45F 3/047 |

OTHER PUBLICATIONS

Black Wearpack, posted at https://www.chvdjustin.com/, no posting date available, online, retrieved Nov. 29, 2023 (Year: 2023).
CHVD Justin 2021 Wearpack, posted on https://www.facebook.com/photo/?fbid=115662107294527&set=pb.100065211862079.-2207520000, posted Apr. 13, 2021, retrieved Nov. 29, 2023, online (Year: 2021).
Student Debuting Handmade Bags at Pop-up Shop, posted Oct. 23, 2019, retrieved Oct. 29, 2023, online, https://www.thelantern.com/2019/10/student-debuting-handmade-bags-at-pop-up-shop/ (Year: 2019).
Izuno Travel, "High Sierra Day Bag Attachable", Mar. 23, 2009, retrieved Dec. 9, 2019, http://www.izunotravel.com/category/packs/.
Rowland, "Multi-stage race backpacks (part 3), Raidlight Evolution 2", retrieved Dec. 9, 2019, http://www.dwrowland.com/2012/12/multi-stage-race-backpacks-part-3.html.
Lyra Mag, "camsafeeV11 camera front pack", [Retrieved Dec. 9, 2019] Website: http://lyramag.blogspot.com/2013/12/backpacks-camera-bags-luggage-urban-and.html.
Donaldson, "Gear Review: Fishpond Thunderhead Submersible BackPack & Chest Pack," Nov. 9, 2020, https://flylordsmag.com/gear-review-fishpond-thunderhead-submersible-backpack-chest-pack/.
"Waterproof Switchpack," L.L.Bean, retrieved Mar. 13, 2024, https://www.llbean.com/llb/shop/1193?originalProduct=123693&productId=1755515&attrValue_0=Asphalt&sku=1000023538&pla1=0&qs=3155274&gad_source=1&gclid=EAIaIQobChMI7_mFt7PihAMVU2BHAR30uwGWEAQYECABEgJyAfD_BwE&gclsrc=aw.ds&SN=PDPStackedRecs_07&SS=A&SN2=eGainChat&SS2=B&SN3=PLPPersonalization_04&SS3=A&noaa_region=southeast.
"Caperlan Chestpack 500 Complete 15L," Decathlon, retrieved Mar. 13, 2024, https://www.decathlon.com/products/chest-pack-500-fishing-backpack-15-1-5-1-328826?variant=39962697334846&gad_source=1&gclid=EAIaIQobChMIrpH4zPfdhAMVSXFHAR06RAUuEAQYAyABEglehfD_BwE.
"Multi-Pack," Zpacks, retrieved Mar. 14, 2024, https://zpacks.com/products/multi-pack.

* cited by examiner

MODULAR WEARABLE TECH GEAR SYSTEM

RELATED APPLICATIONS AND PRIORITY

This application is a continuation application of U.S. application Ser. No. 17/300,326, granted conversion from a provisional application of U.S. App. No. 63/436,023, filed Dec. 29, 2022, which is a continuation application of U.S. application Ser. No. 29/708,028, filed Oct. 2, 2019, the contents of which are incorporated herein by reference in their entireties.

FIELD OF THE INVENTION

The present disclosure is directed to modular wearable gear. More specifically, the present disclosure is directed to modular wearable tech gear systems.

BACKGROUND OF THE INVENTION

Known wearable devices for carrying items include backpacks, fanny packs, handbags, shoulder bags, and messenger bags. Each of these devices is functional and/or fashionable only in very limited ways and is not adaptable for use with other wearable devices.

BRIEF DESCRIPTION OF THE INVENTION

In one embodiment, a modular wearable system includes a backpack including a backpack body and backpack fasteners on backpack straps extending from the backpack body, a handbag including a handbag body and handbag fasteners on handbag straps and a handle extending from the handbag body, and a vest including a vest body and vest fasteners on vest straps extending from the vest body. At least two of the backpack fasteners reversibly couple to at least two of the handbag fasteners to form a first wearable combination. At least two of the handbag fasteners couple to at least two of the vest fasteners to form a second wearable combination.

In another embodiment, a modular wearable system includes a backpack including a backpack body and backpack fasteners on backpack straps extending from the backpack body, a handbag including a handbag body and handbag fasteners on handbag straps and a handle extending from the handbag body, and a shoulder bag strap including a pair of shoulder bag strap fasteners. At least two of the backpack fasteners reversibly couple to at least two of the handbag fasteners to form a first wearable combination. The pair of shoulder bag fasteners reversible couple to a pair of the handbag fasteners to form a second wearable combination.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a modular wearable system. The modular wearable system includes at least two wearable components that may be worn attached to each other or worn individually alone or separately together.

Embodiments of the present disclosure, for example, in comparison to concepts failing to include one or more of the features disclosed herein, provide wearing versatility, provide style versatility, provide carrying versatility, provide activity versatility, or combinations thereof.

In exemplary embodiments, a backpack, a handbag, and/or a vest of a modular wearable system can each be worn or carried individually alone or can be coupled to one or more other components of the modular wearable system. In exemplary embodiments, the modular wearable system also includes a shoulder bag strap for additional versatility in wearing or carrying the handbag.

Wearable combinations of components of the modular wearable system may include, but are not limited to, the handbag attached to the backpack with the handbag body being worn on the front of the torso and the backpack body being worn on the back of the torso, the handbag attached to the backpack with the handbag body and the backpack body being worn on the back of the torso, the handbag attached to the vest with the handbag body being worn on the front of the torso and the vest body being worn on the back of the torso, the handbag attached to the shoulder bag strap and carried over the shoulder as a shoulder bag, the handbag attached to the shoulder bag strap and carried over the shoulder and across the body as a messenger bag, or the handbag attached to the shoulder bag strap and worn around the waist as a fanny pack.

Figure 2:
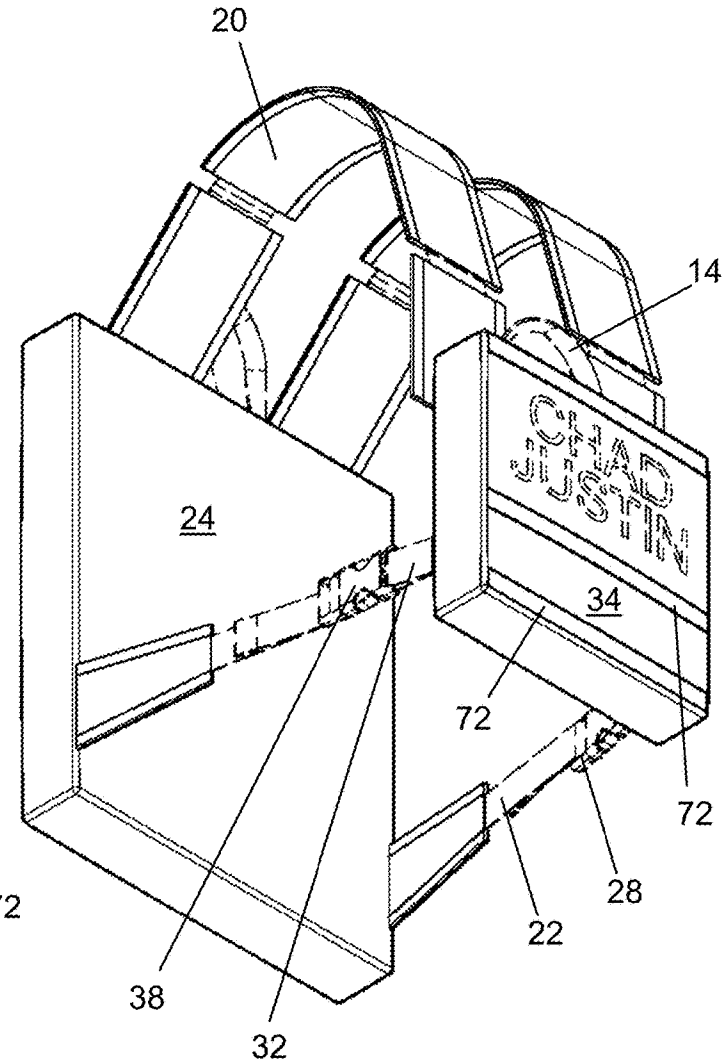
FIG. 2 is a bottom-front-left perspective view of the first configuration of FIG. 1.
Figure 1:
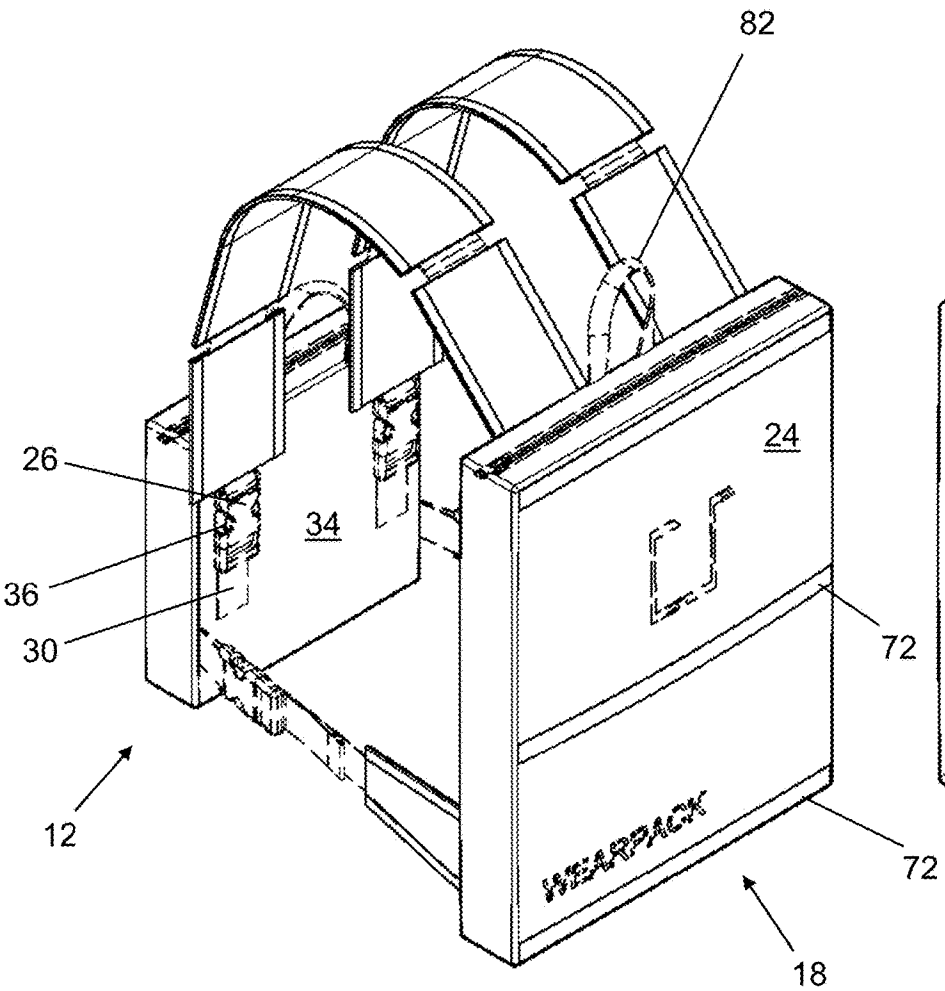
FIG. 1 is a top-rear-right perspective view of a first configuration of a handbag attached to a backpack of a modular wearable system.
Figure 3:
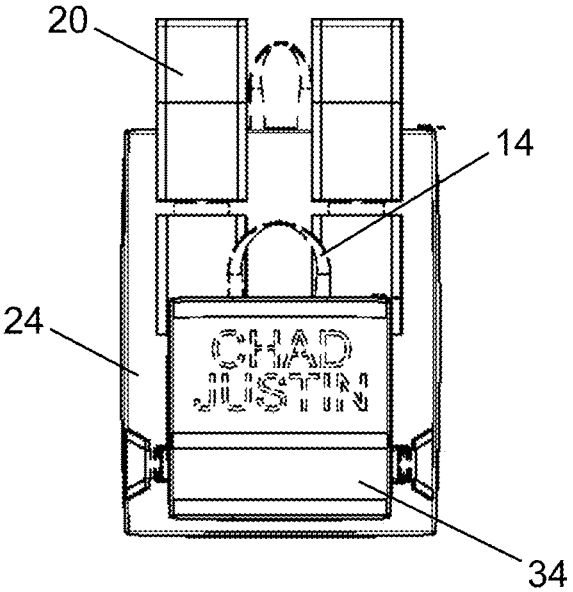
FIG. 3 is a front view of the first configuration of FIG. 1.
Figure 4:
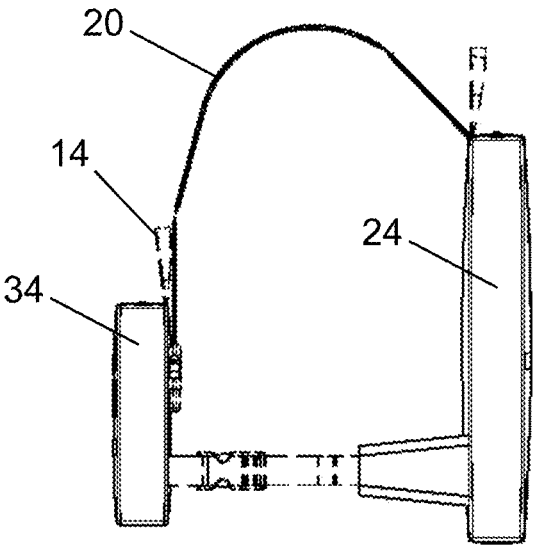
FIG. 4 is a right view of the first configuration of FIG. 1.
Figure 5:
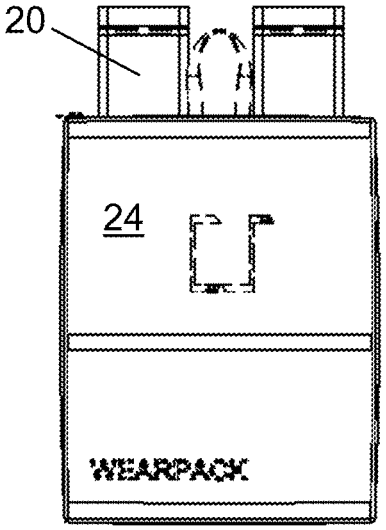
FIG. 5 is a rear view of the first configuration of FIG. 1.
Figure 6:
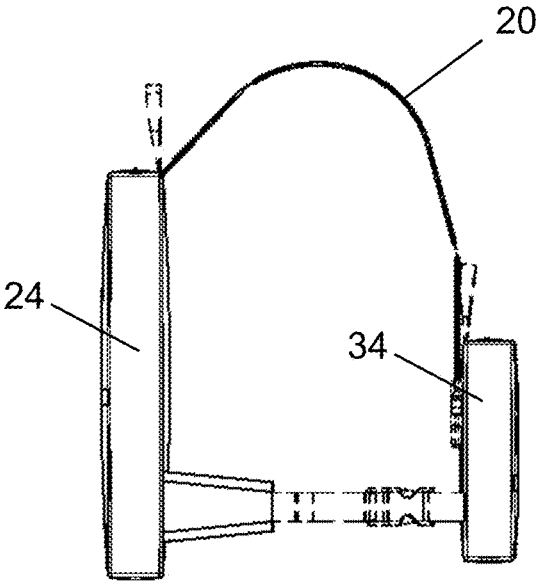
FIG. 6 is a left view of the first configuration of FIG. 1.
Figure 7:
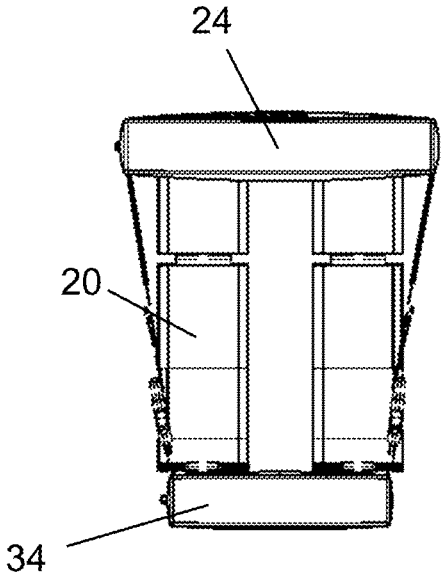
FIG. 7 is a bottom view of the first configuration of FIG. 1.
Figure 8:
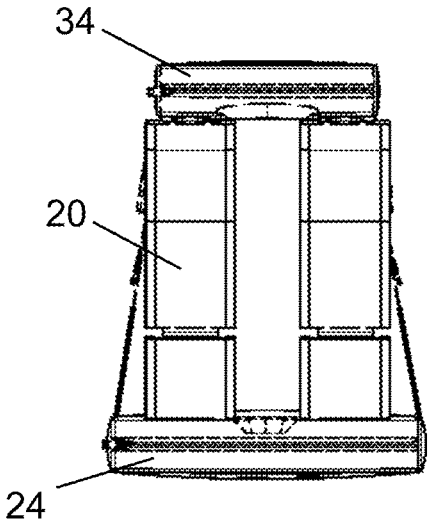
FIG. 8 is a top view of the first configuration of FIG. 1.
Figure 9:
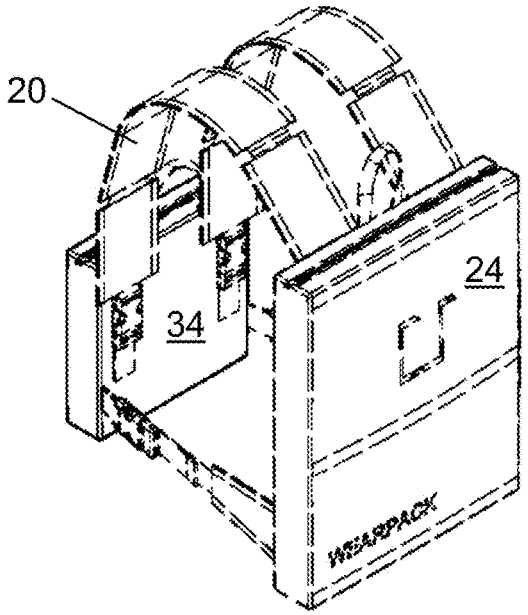
FIG. 9 is another top-rear-right perspective view of the first configuration of FIG. 1.
Figure 10:
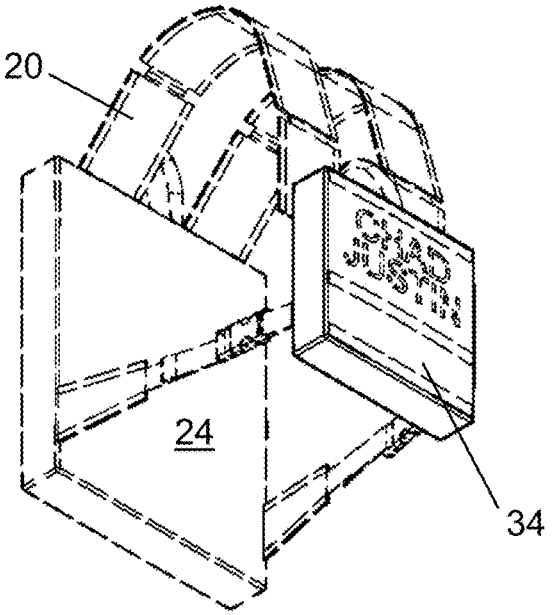
FIG. 10 is another bottom-front-left perspective view of the first configuration of FIG. 1.
Figure 11:
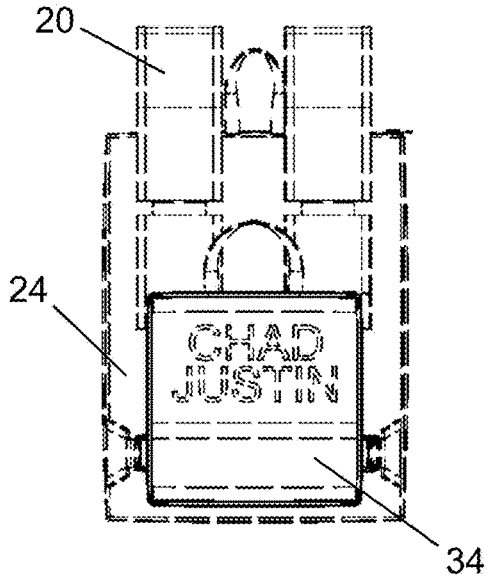
FIG. 11 is another front view of the first configuration of FIG. 1.
Figure 12:
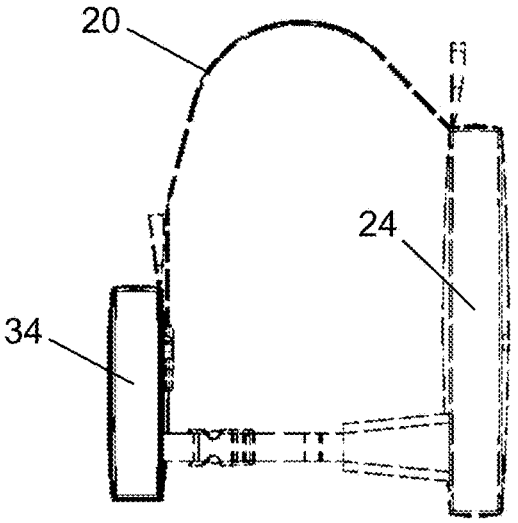
FIG. 12 is another right view of the first configuration of FIG. 1.
Figure 13:
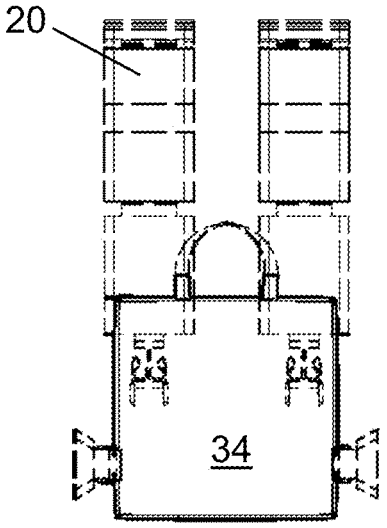
FIG. 13 is a partial rear view of the first configuration of FIG. 1 without the backpack body being shown for clarity.
Figure 14:
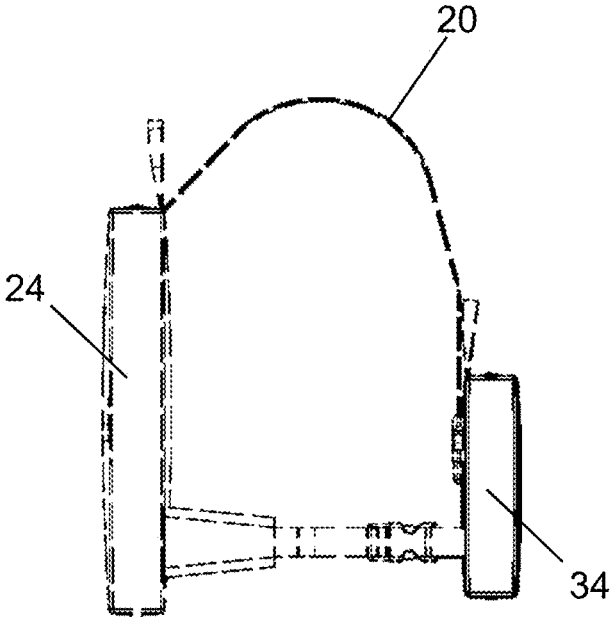
FIG. 14 is another left view of the first configuration of FIG. 1.
Figure 15:
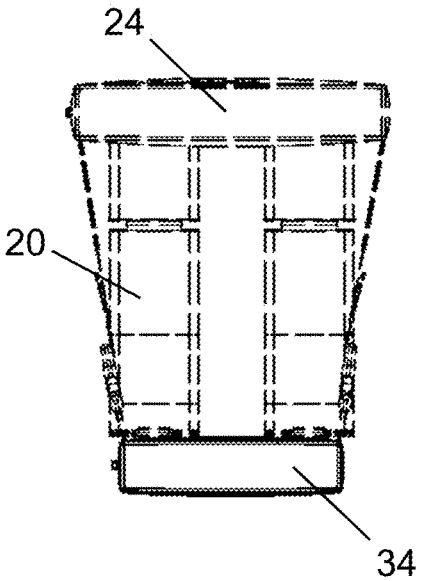
FIG. 15 is another bottom view of the first configuration of FIG. 1.
Figure 16:
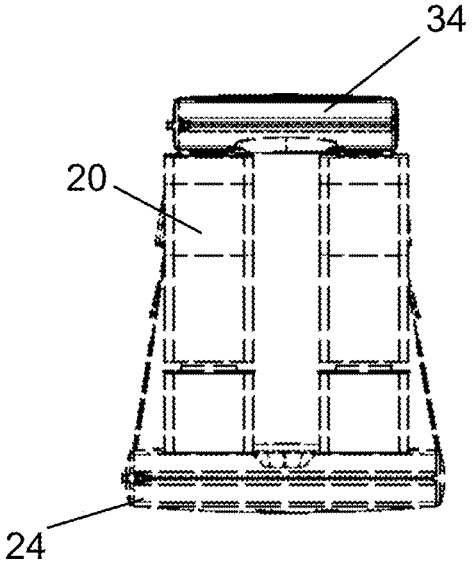
FIG. 16 is another top view of the first configuration of FIG. 1.
Figure 17:
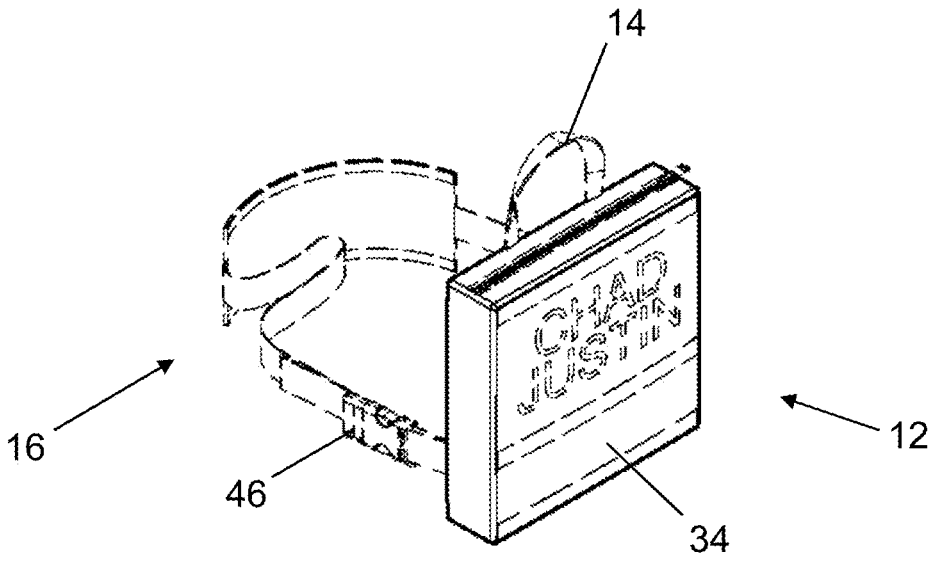
FIG. 17 is a top-front-left perspective view of a second configuration of a shoulder bag strap attached to the handbag of a modular wearable system.
Figure 18:
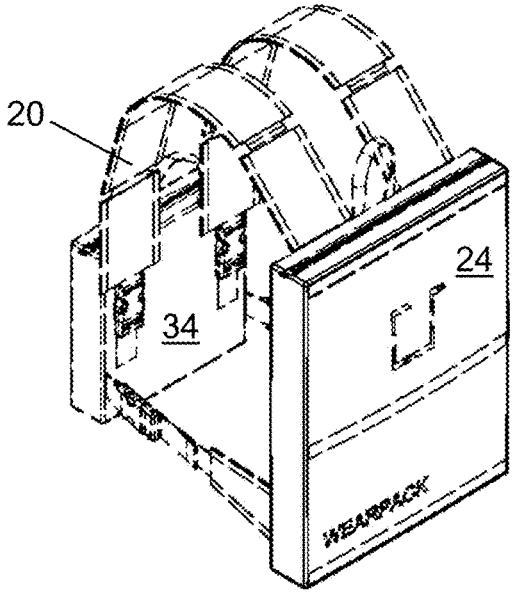
FIG. 18 is another top-rear-right perspective view of the first configuration of FIG. 1.
Figure 19:
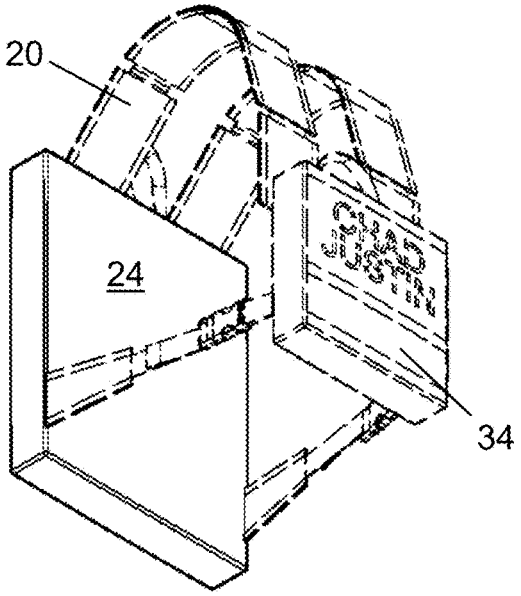
FIG. 19 is another bottom-front-left perspective view of the first configuration of FIG. 1.
Figure 20:
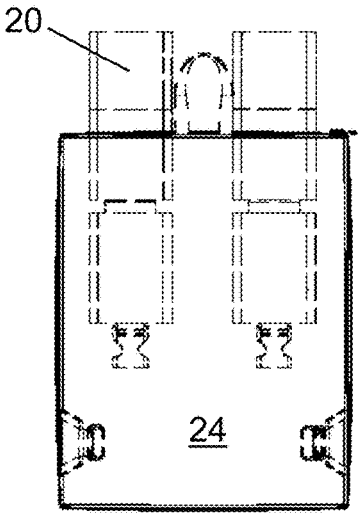
FIG. 20 is another front view of the first configuration of FIG. 1 without the handbag being shown for clarity.
Figure 21:
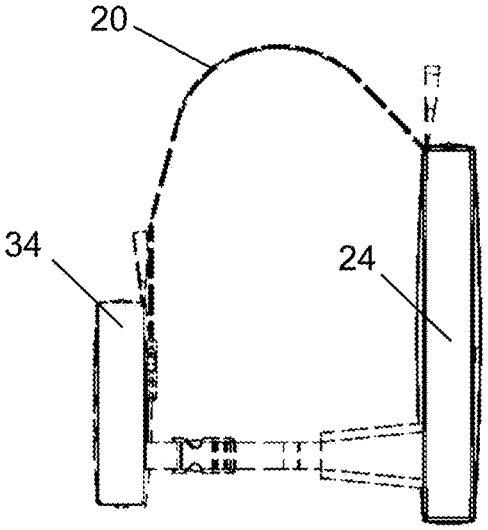
FIG. 21 is another right view of the first configuration of FIG. 1.
Figure 22:
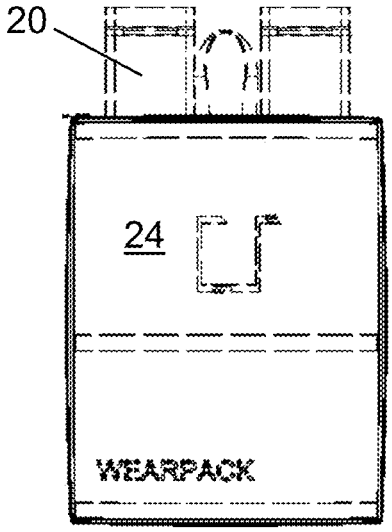
FIG. 22 is another rear view of the first configuration of FIG. 1.
Figure 23:
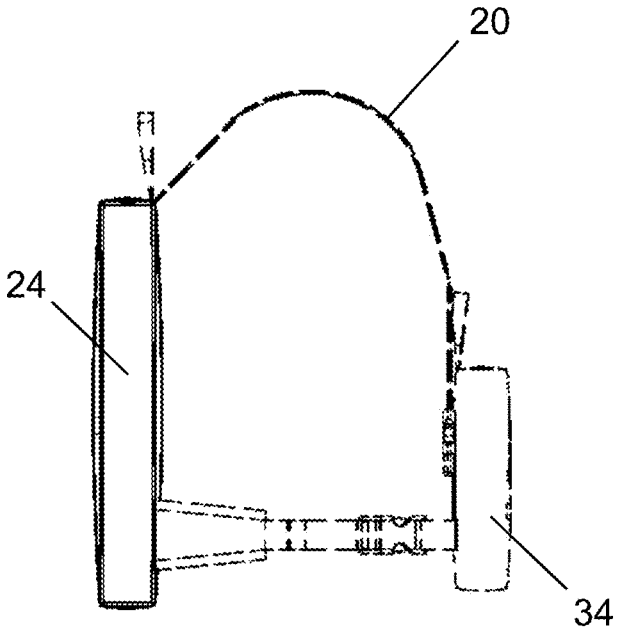
FIG. 23 is another left view of the first configuration of FIG. 1.
Figure 24:
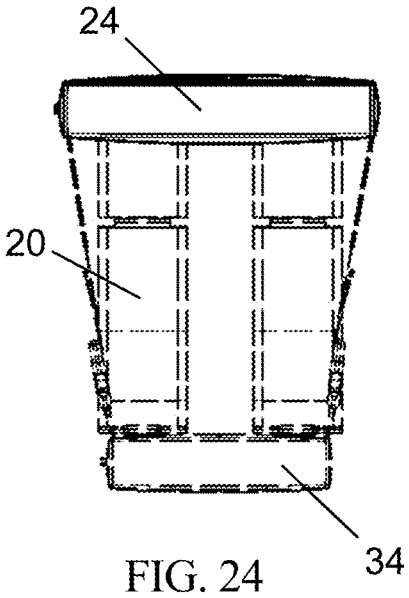
FIG. 24 is another bottom view of the first configuration of FIG. 1.
Figure 25:
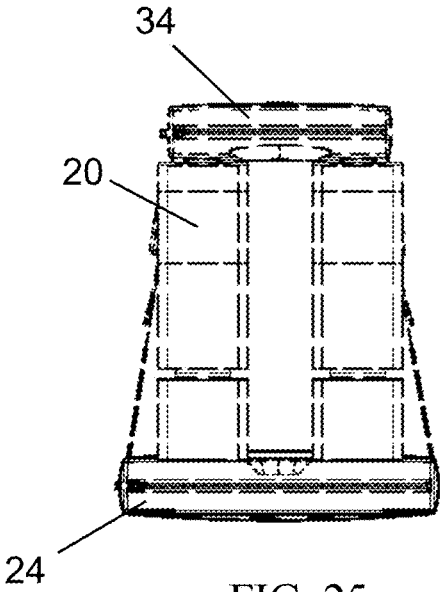
FIG. 25 is another top view of the first configuration of FIG. 1.
Figure 26:
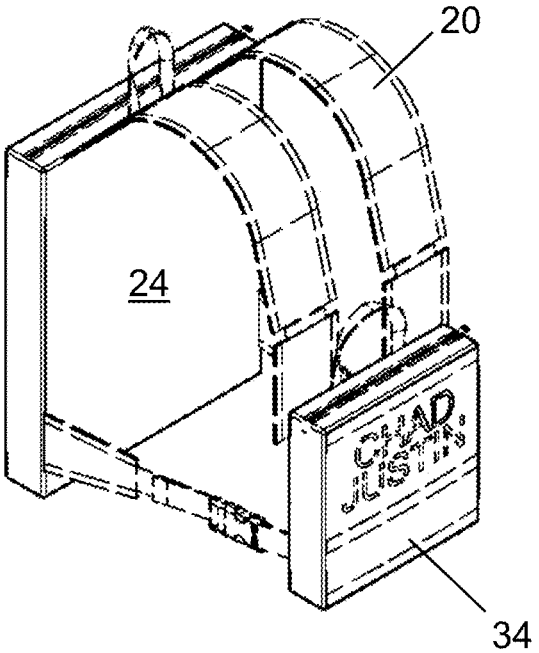
FIG. 26 is a top-front-left perspective view of the first configuration of FIG. 3.
Figure 27:
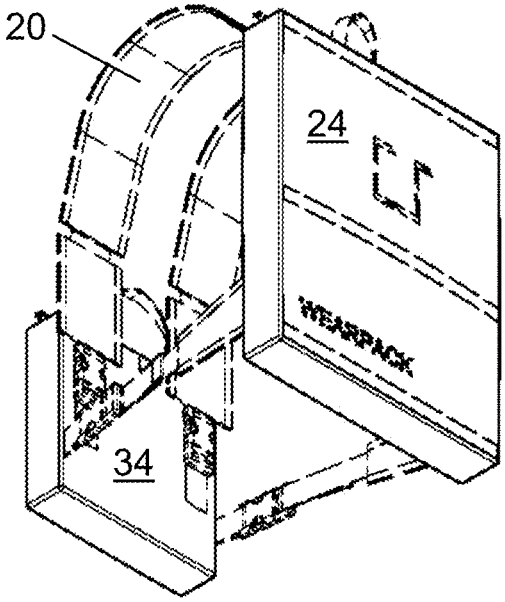
FIG. 27 is a bottom-rear-right perspective view of the first configuration of FIG. 3.
Figure 28:
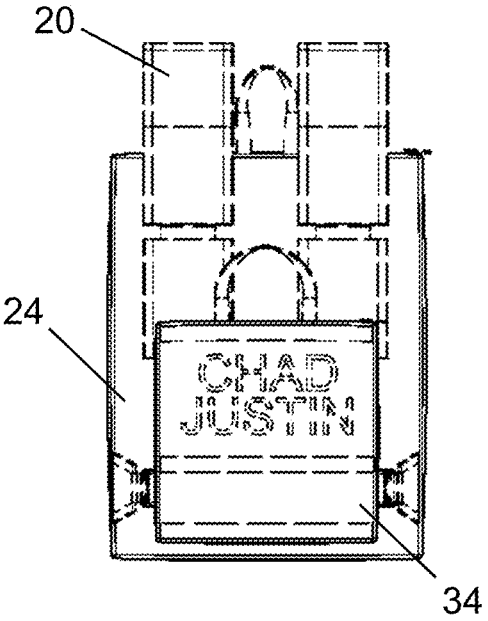
FIG. 28 is another front view of the first configuration of FIG. 1.
Figure 29:
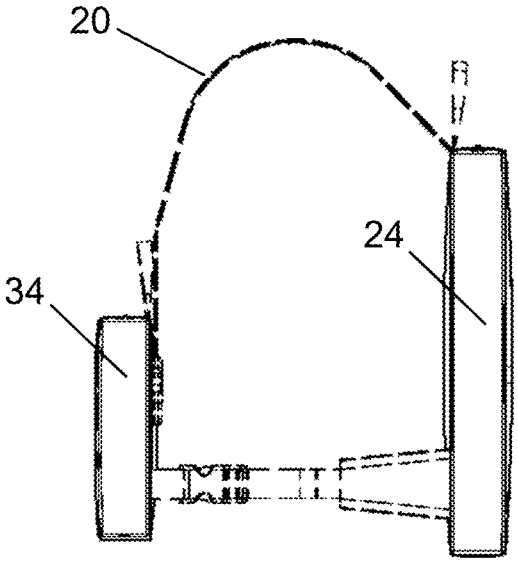
FIG. 29 is another right view of the first configuration of FIG. 1.
Figure 30:
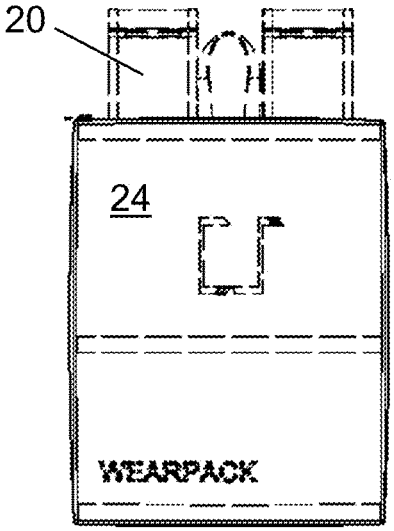
FIG. 30 is another rear view of the first configuration of FIG. 1.
Figure 31:
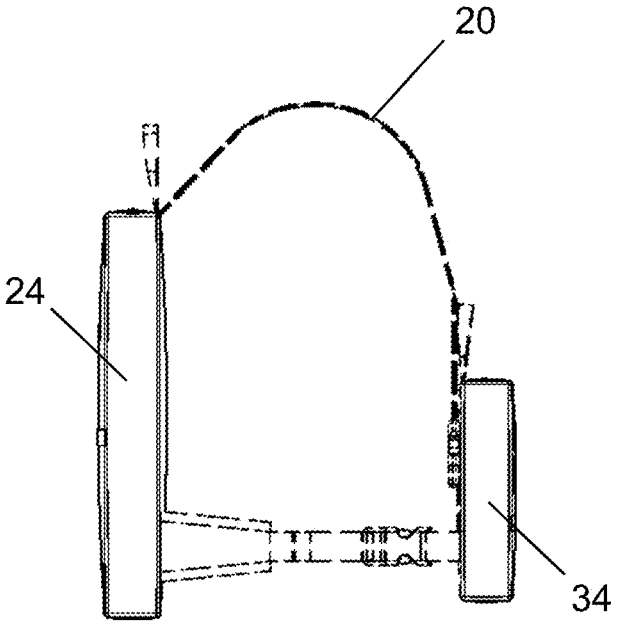
FIG. 31 is another left view of the first configuration of FIG. 1.
Figure 32:
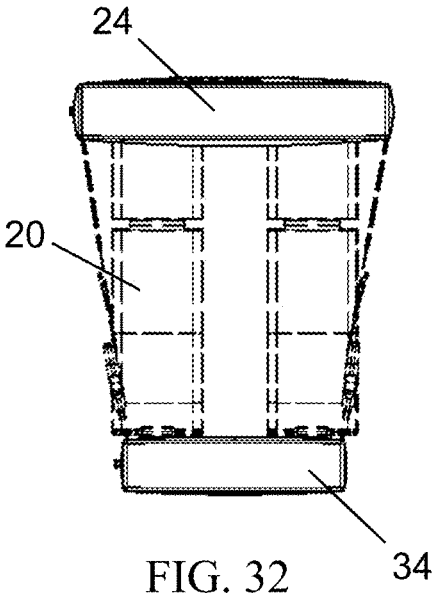
FIG. 32 is another bottom view of the first configuration of FIG. 1.
Figure 33:
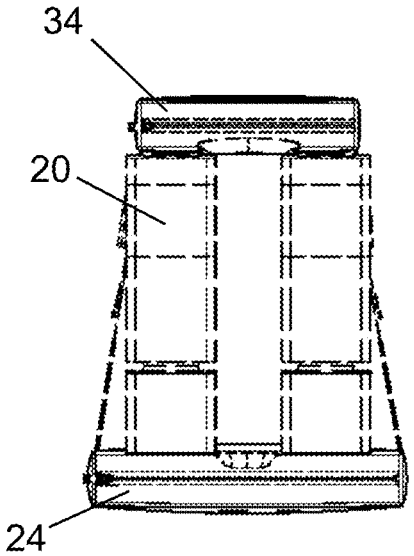
FIG. 33 is another top view of the first configuration of FIG. 1.
Figure 62:
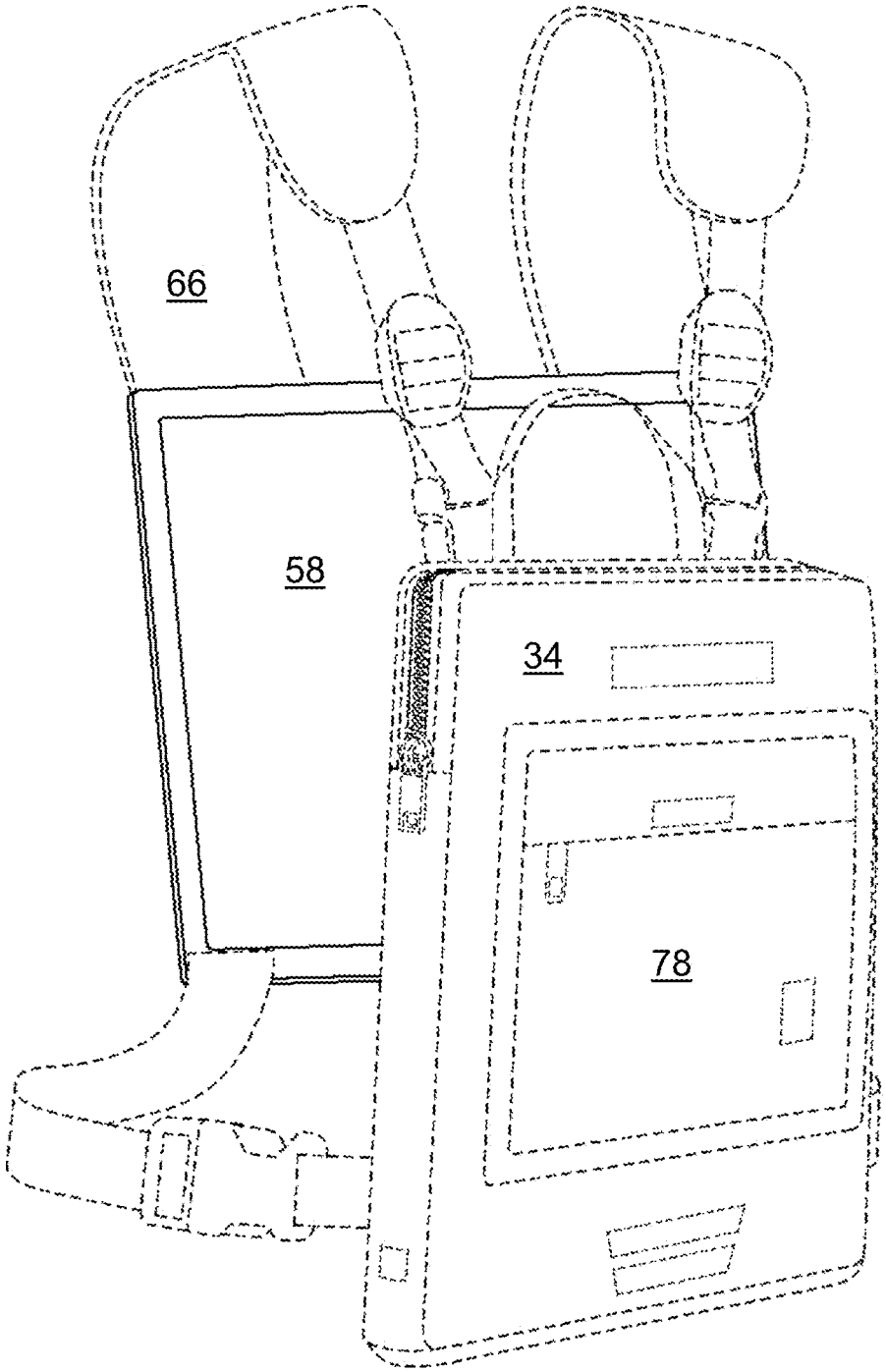
FIG. 62 is another front-right perspective view of the vest and handbag of FIG. 59.

Referring to FIGS. 1-62, a modular wearable system includes a vest 10, a handbag 12 with a permanent handle 14, a shoulder bag strap 16, and a backpack 18. The modular wearable system is a versatile system.

As shown in FIGS. 1-16, 18-33, and 35-46, the backpack 18 and the handbag 12 can be reversibly attached to each other and worn as a single unit.

As shown in FIGS. 1-16, 18-46, and 49, the backpack 18 includes two shoulder straps 20 and two torso straps 22 that extend from the backpack body 24. Each shoulder strap 20 may be adjustable in length and includes a shoulder fastener 26. Each torso strap 22 may be adjustable in length and includes a torso fastener 28 reversibly couplable to one of the shoulder fasteners 26.

Figure 49:
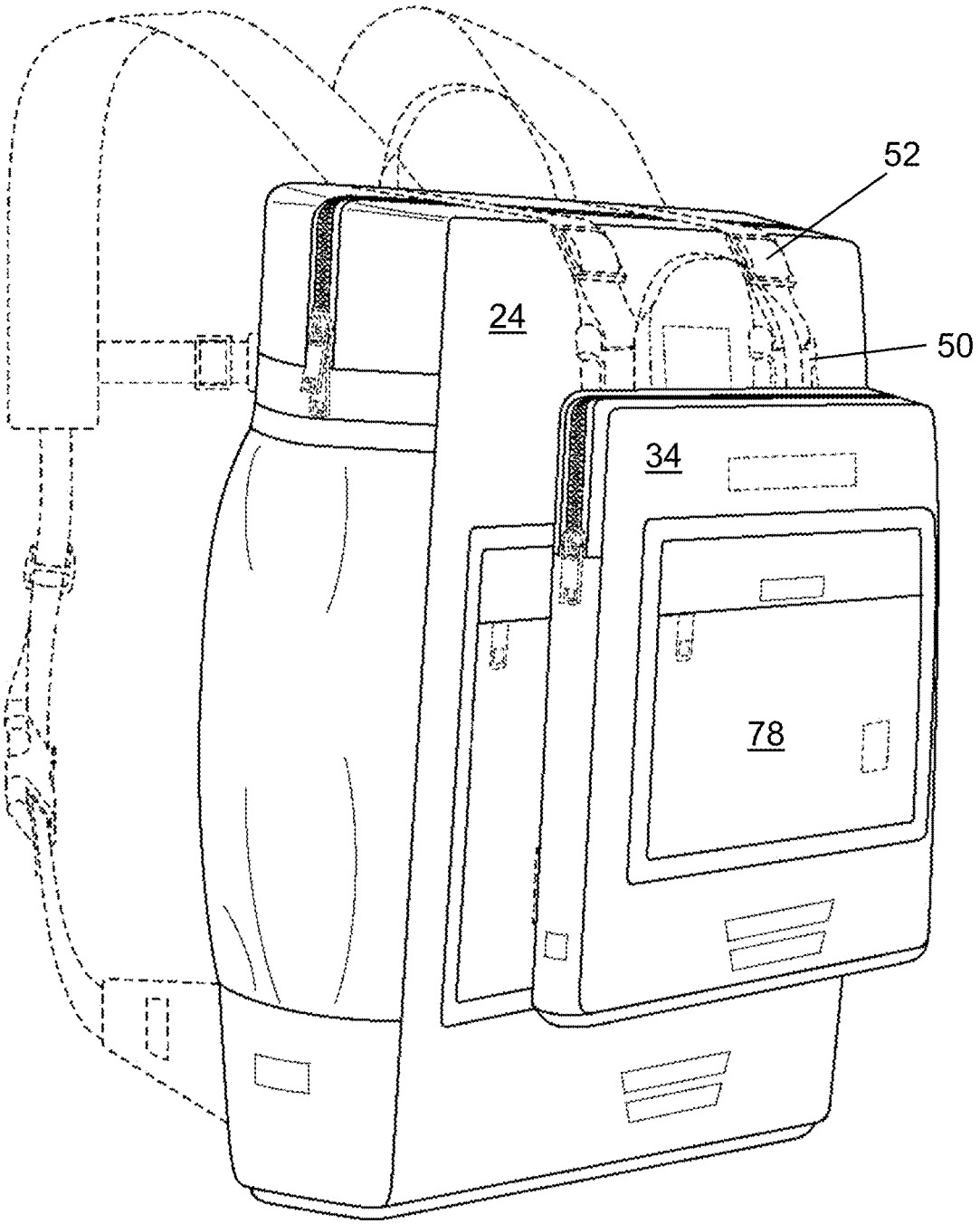
FIG. 49 is a rear-left perspective view of the backpack and handbag of FIG. 35 in a fourth configuration of the modular wearable system.
Figure 50:
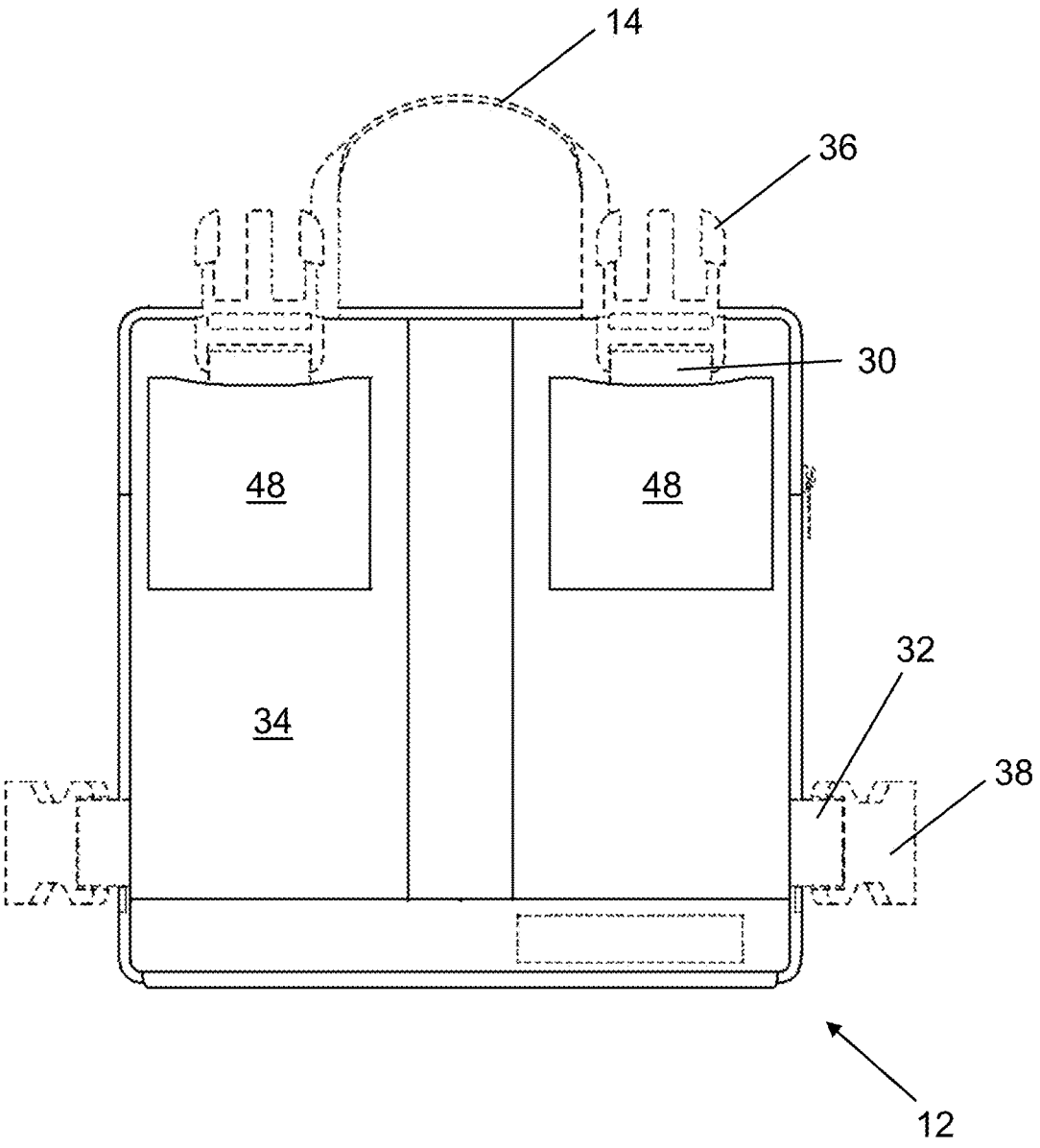
FIG. 50 is a rear view of the handbag of FIG. 35.
Figure 51:
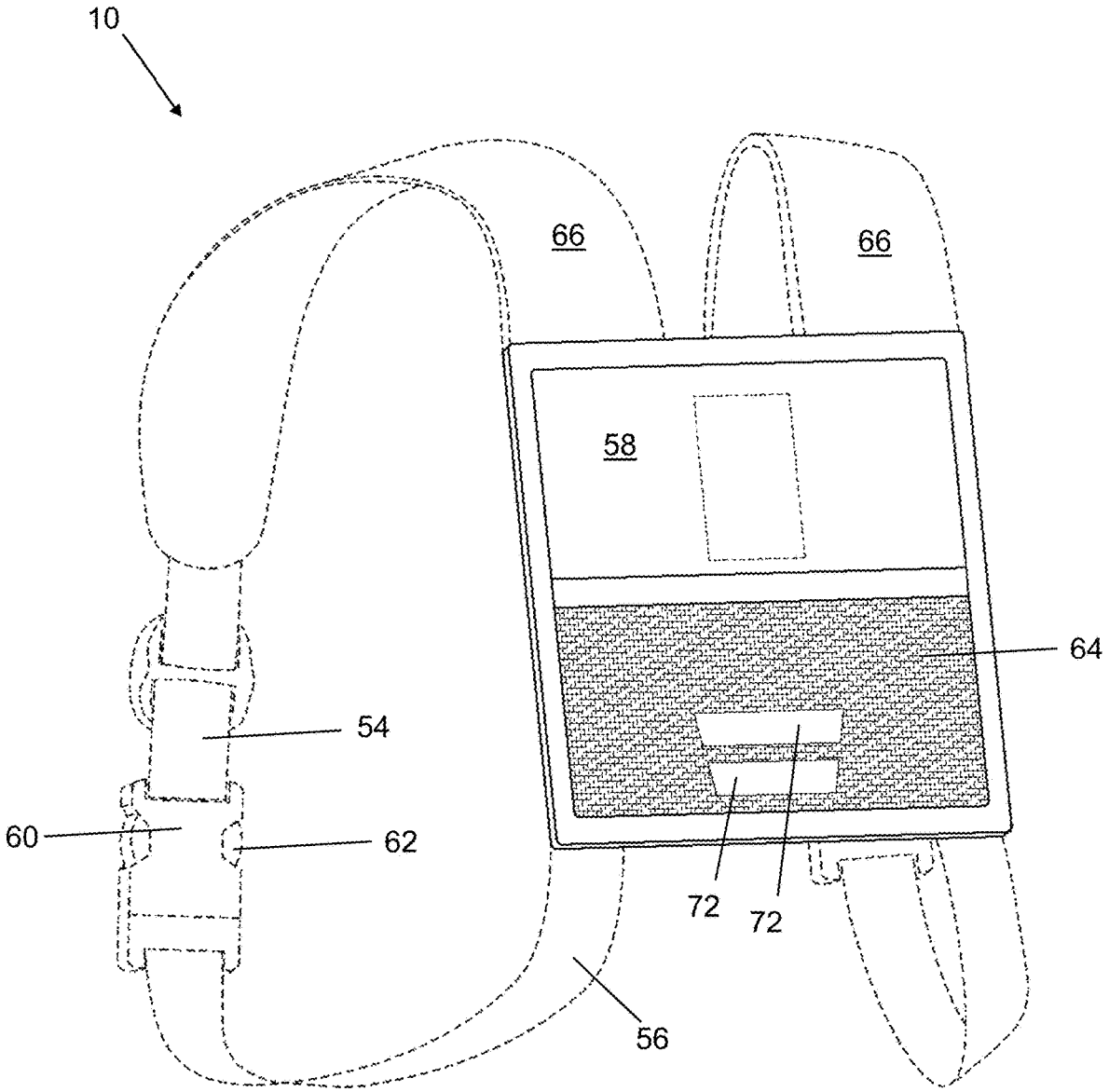
FIG. 51 is a rear-right perspective view of a vest of a modular wearable system.
Figure 52:
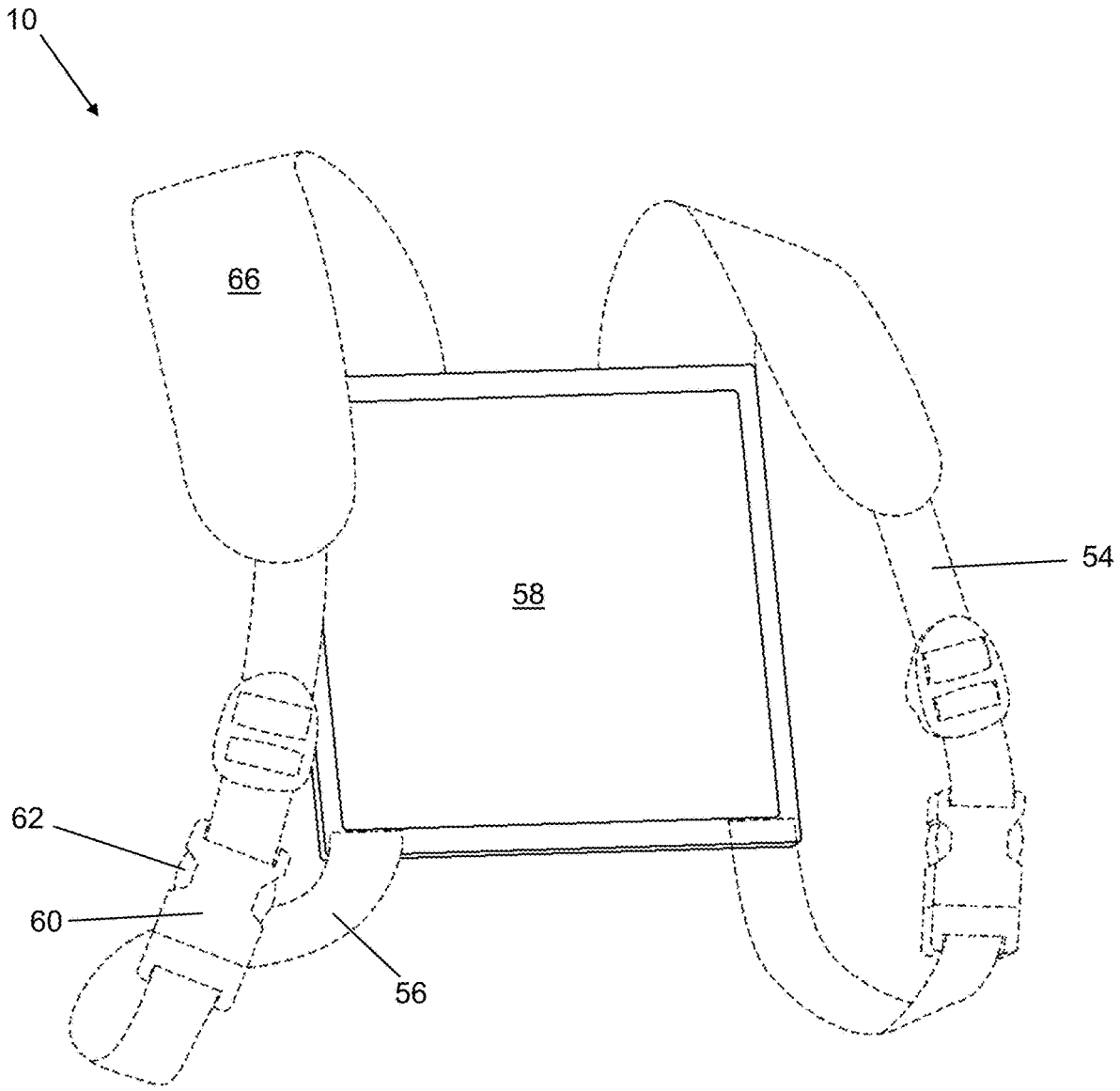
FIG. 52 is a front view of the vest of FIG. 51.
Figure 53:
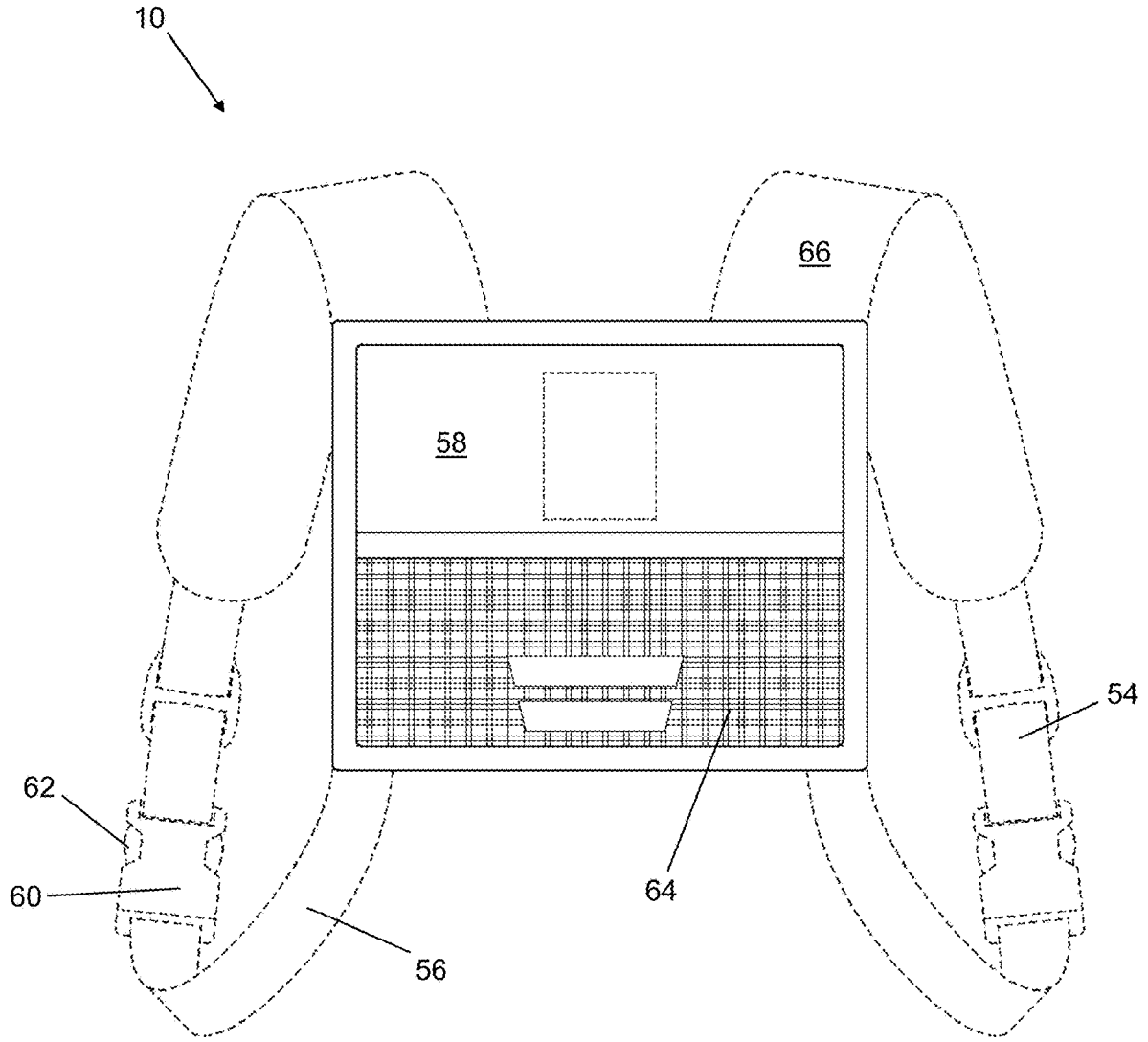
FIG. 53 is a rear view of the vest of FIG. 51.
Figure 54:
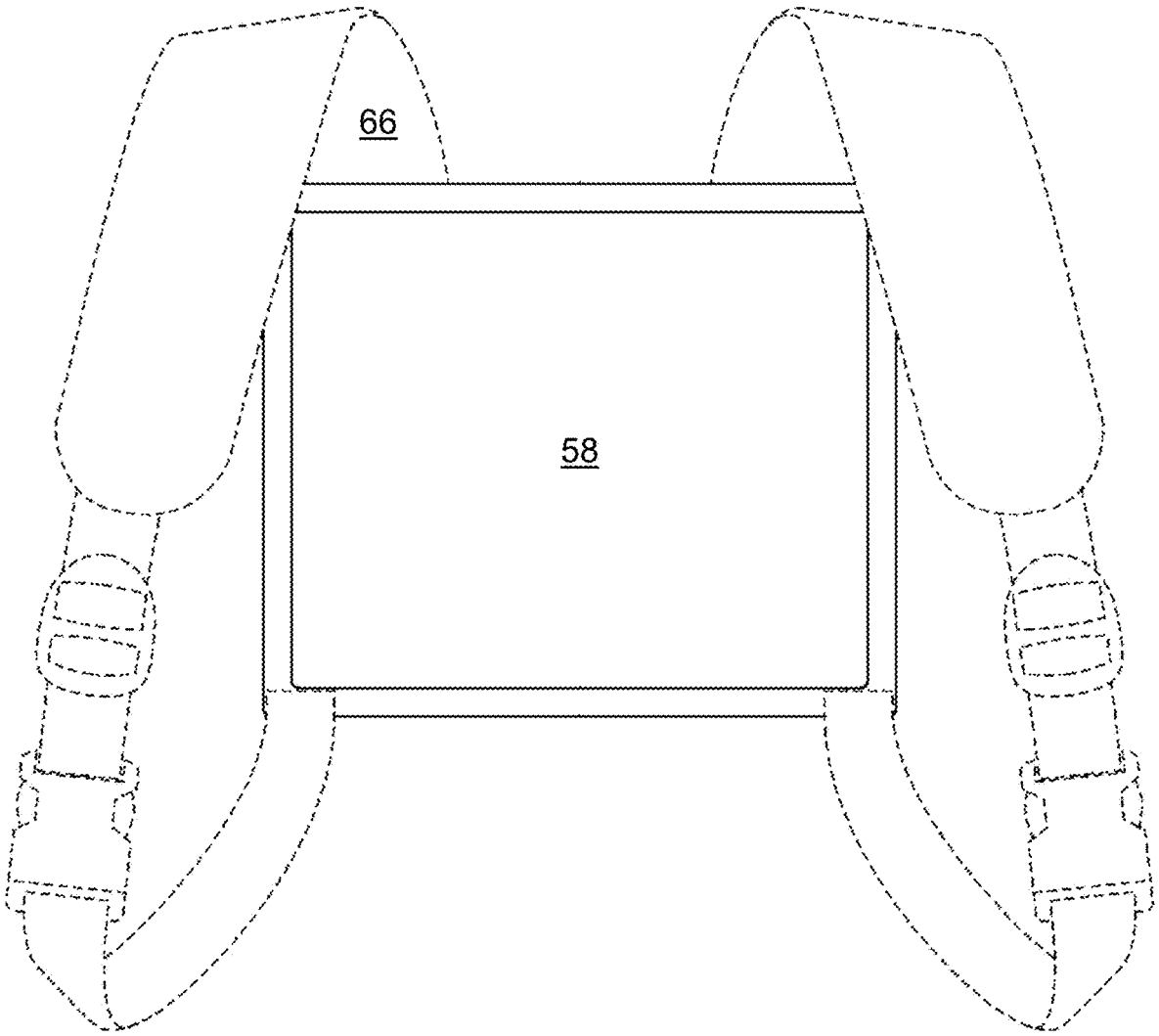
FIG. 54 is another front view of the vest of FIG. 51.
Figure 55:
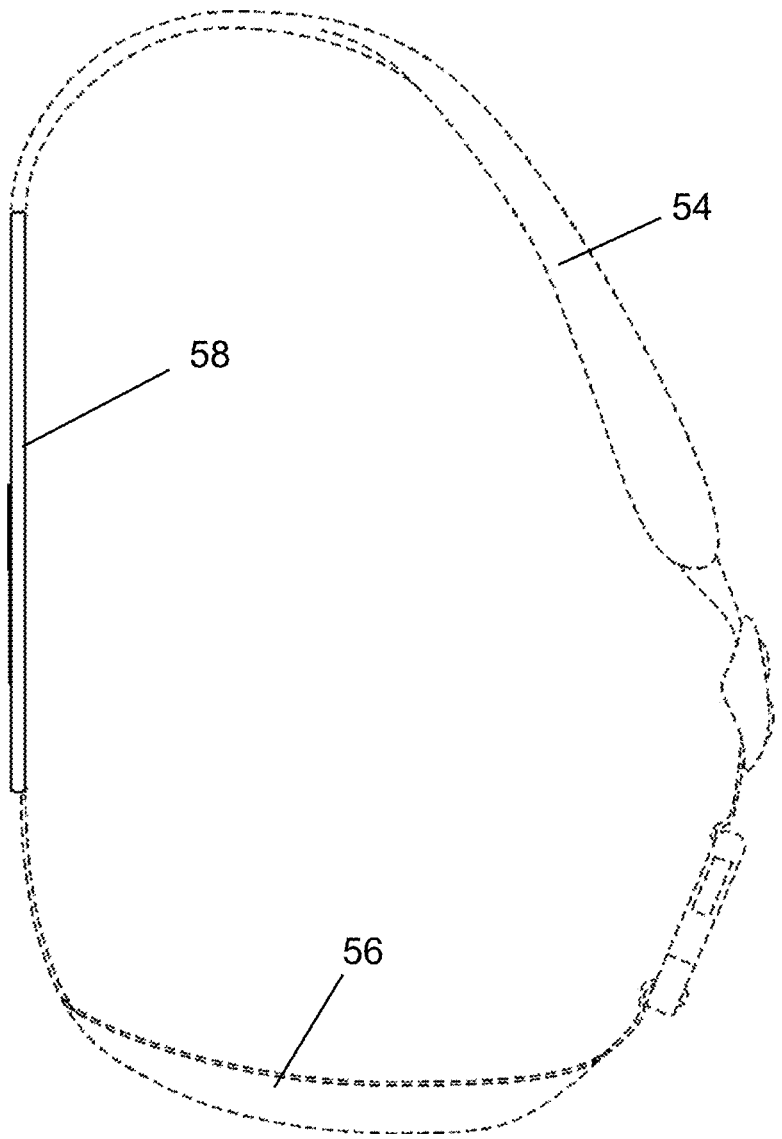
FIG. 55 is a left view of the vest of FIG. 51.
Figure 56:
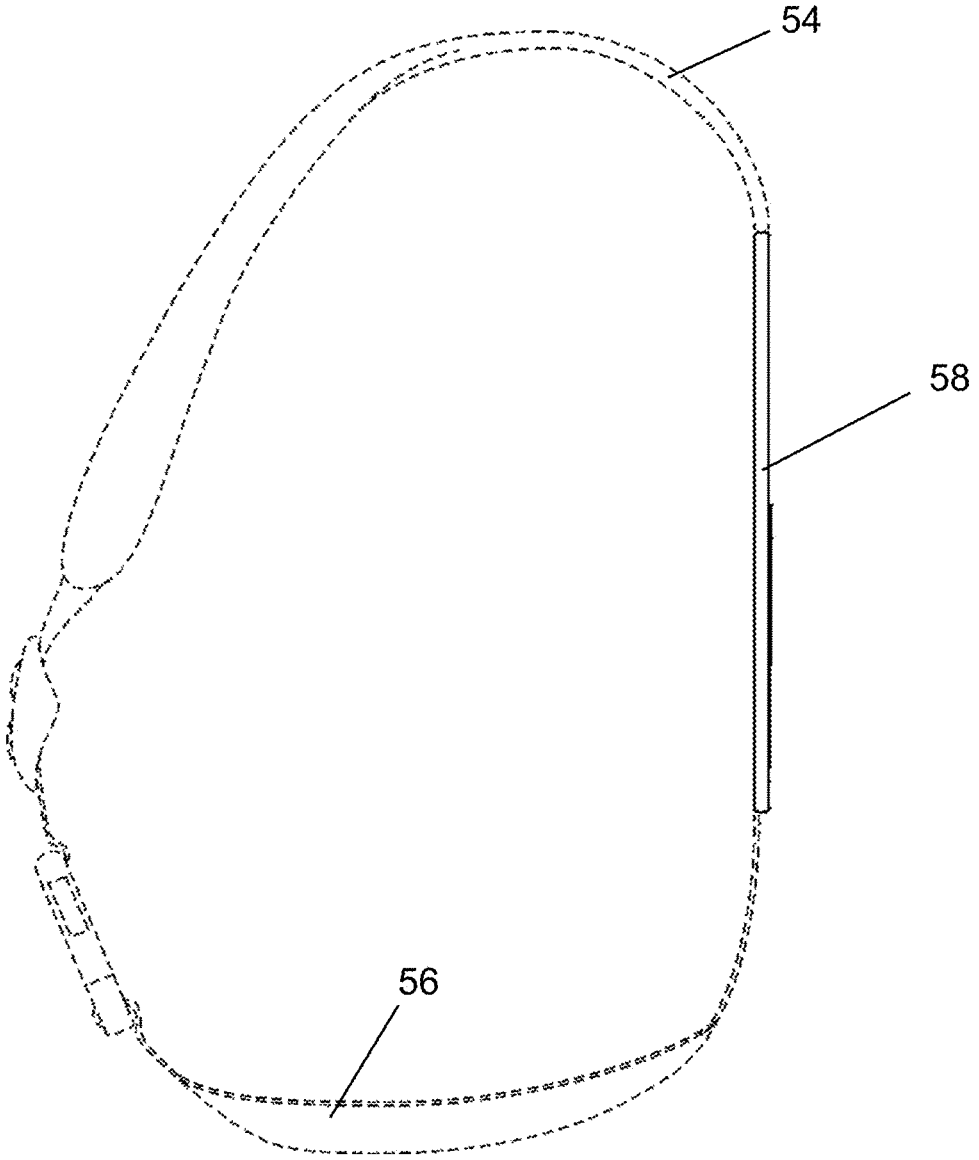
FIG. 56 is a right view of the vest of FIG. 51.
Figure 57:
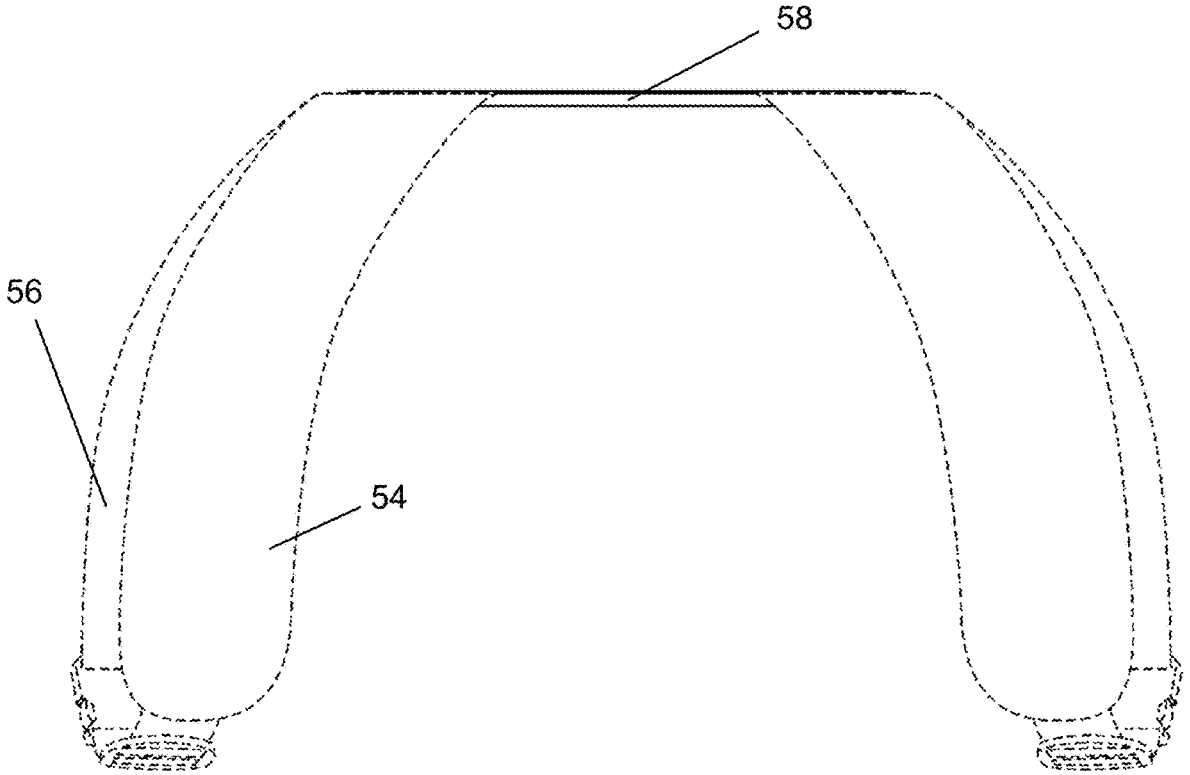
FIG. 57 is a top view of the vest of FIG. 51.
Figure 58:
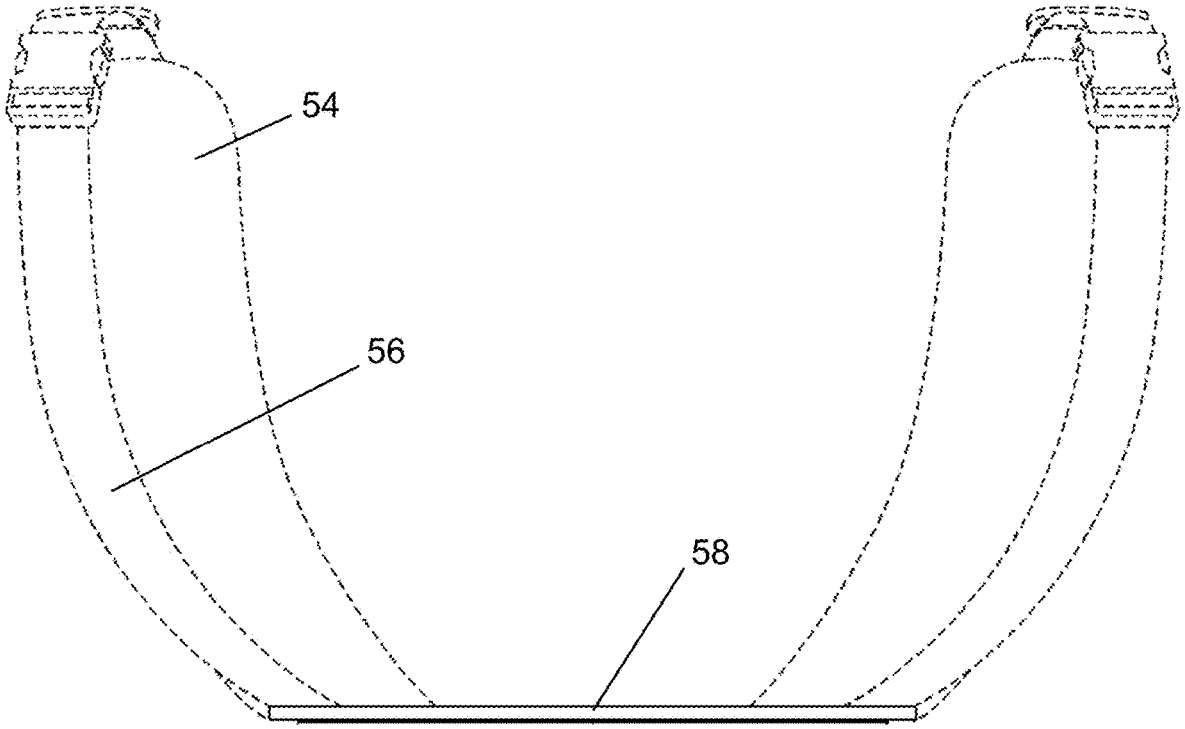
FIG. 58 is a bottom view of the vest of FIG. 51.
Figure 59:
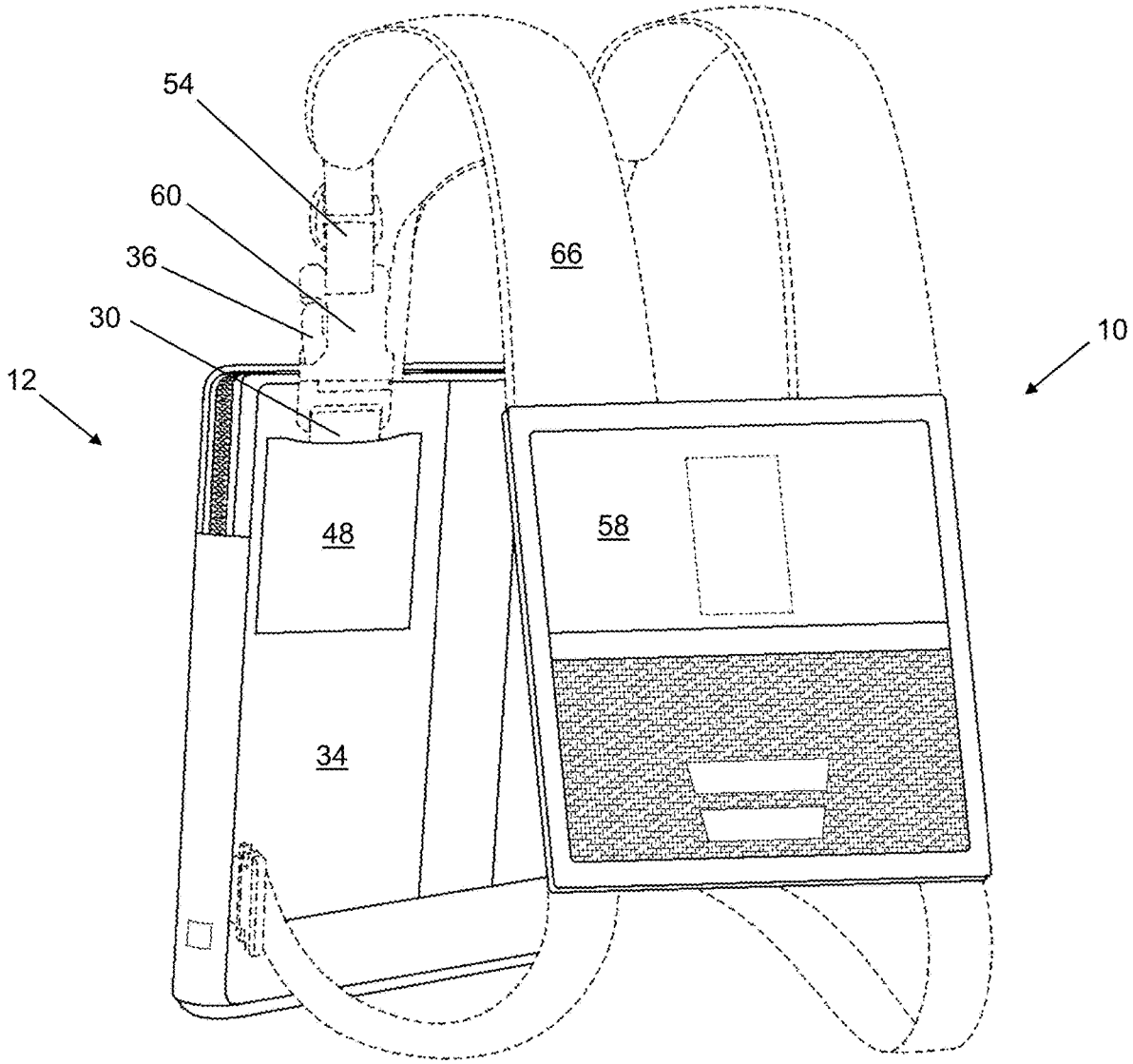
FIG. 59 is a rear-right perspective view of a fifth configuration of the handbag attached to the vest of the modular wearable system.
Figure 60:
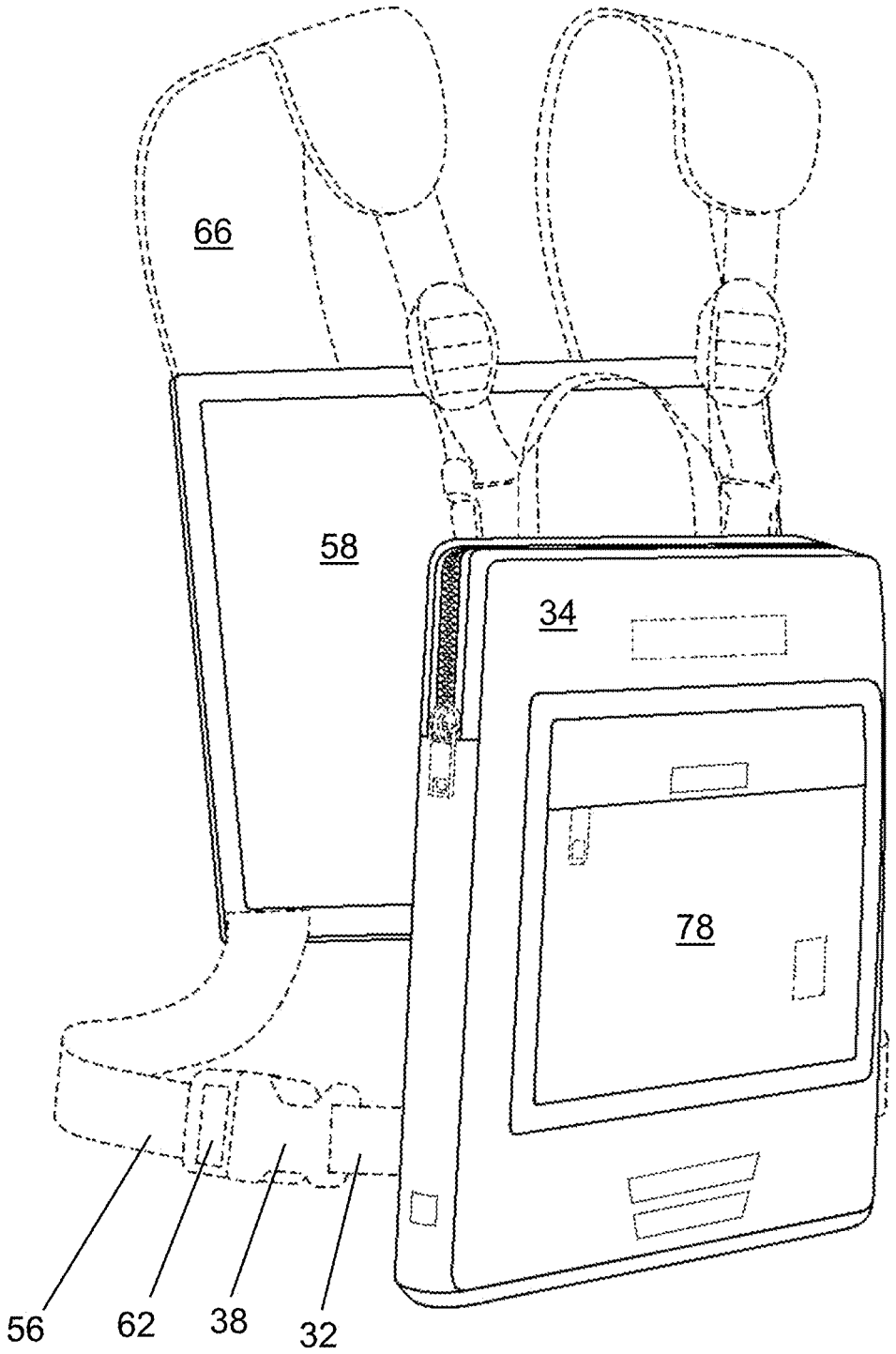
FIG. 60 is a front-left perspective view of the vest and handbag of FIG. 59.
Figure 61:
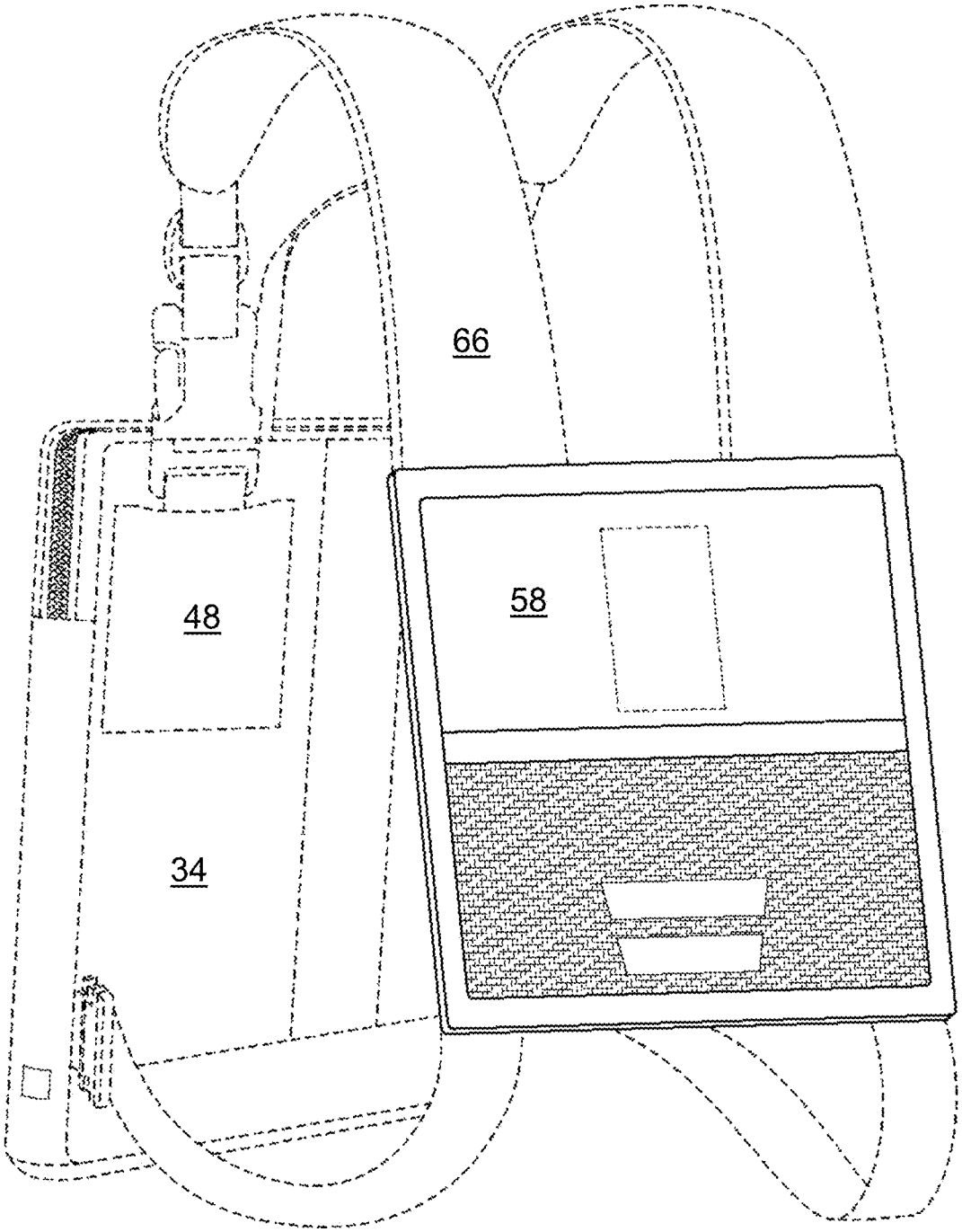
FIG. 61 is another rear-right perspective view of the vest and handbag of FIG. 59.

As shown in FIGS. 1-50 and 59-62 and best seen in FIG. 50, the handbag 12 includes two shoulder straps 30 and two torso straps 32 extending from the handbag body 34. The shoulder straps 30 and the torso straps 32 of the handbag 12 are much shorter than the shoulder straps 20 and torso straps 22 of the backpack 18 and are not adjustable in length. Each shoulder strap 30 includes a shoulder fastener 36 reversibly couplable to one of the shoulder fasteners 26 of the backpack 18. Each torso strap 32 includes a torso fastener 38 reversibly couplable to one of the torso fasteners 28 of the backpack 18.

As shown in FIGS. 1-16, 18-33, and 35-46, this configuration of the backpack 18 and handbag 12 can be worn around the torso of a user, with the backpack body 24 on the back of the user, the handbag body 34 on the front of the torso of the user, and the shoulder straps 20 resting on the shoulders of the user. In some embodiments, the shoulder straps 20 include a shoulder portion 40 that may be wider and/or padded for added user comfort.

Figure 34:
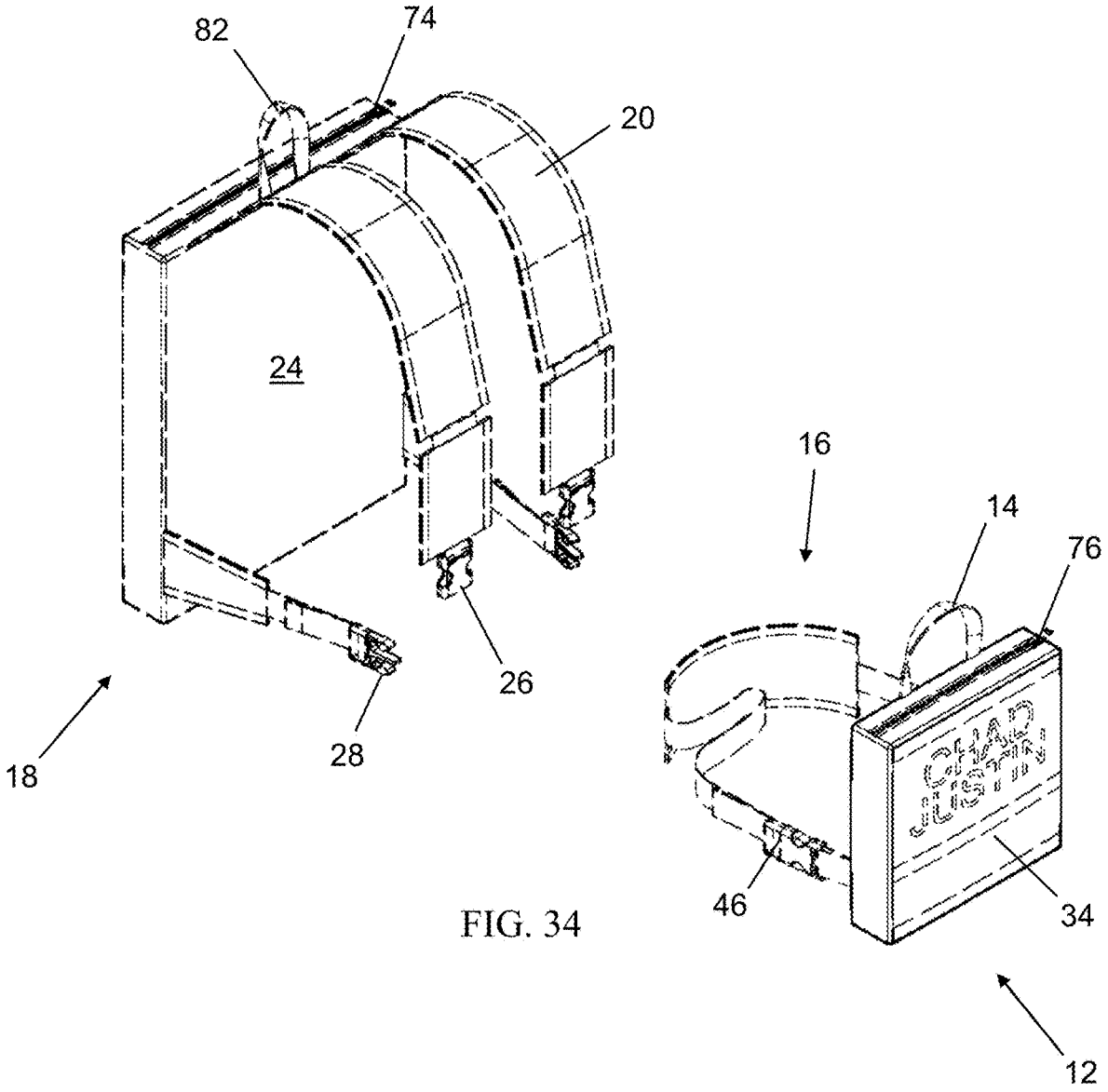
FIG. 34 is a top-front-left perspective view of the backpack and handbag of the modular wearable system of FIG. 1 separated from each other and with the handbag attached to the shoulder bag strap as shown in FIG. 17.
Figure 37:
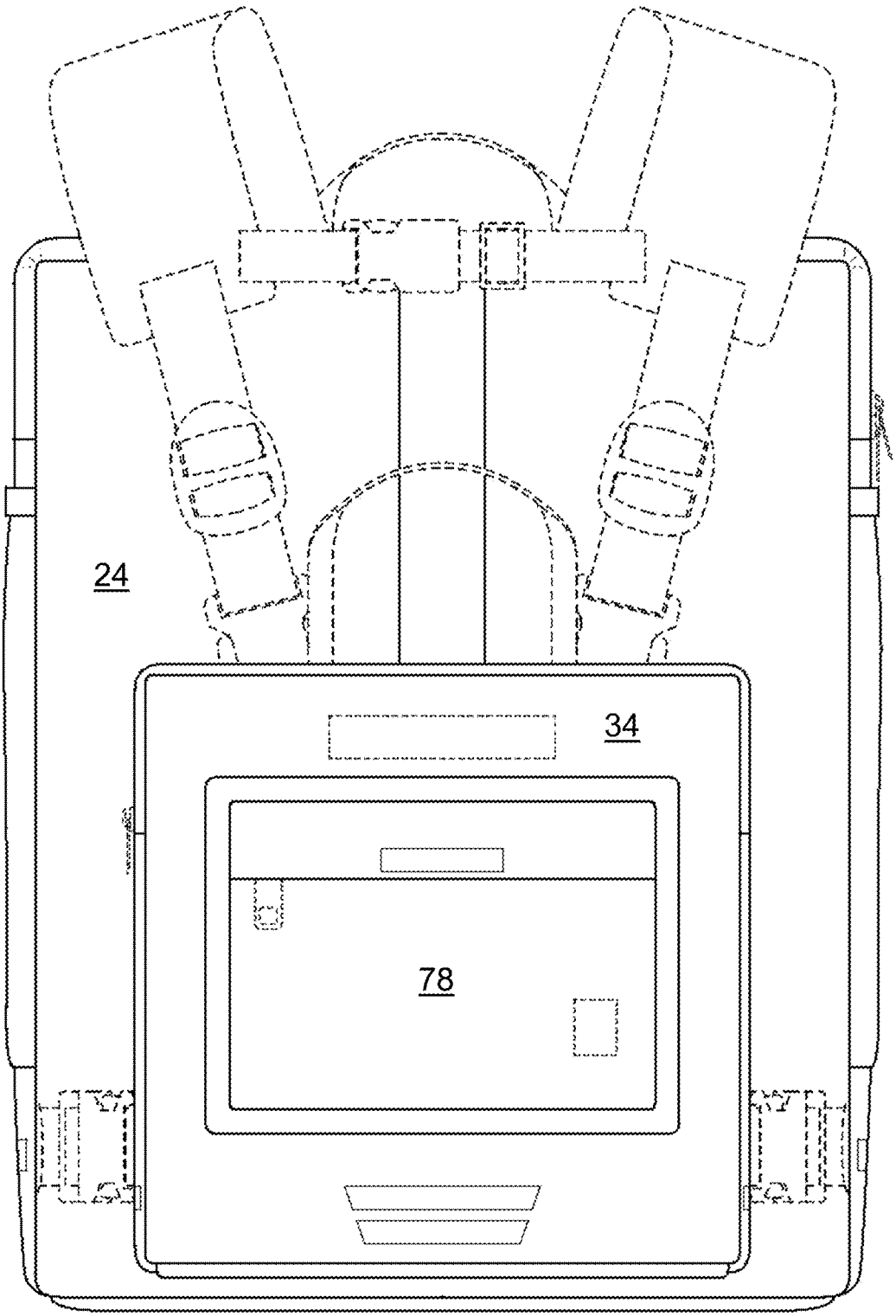
FIG. 37 is a front view of the backpack and handbag of FIG. 35.
Figure 38:
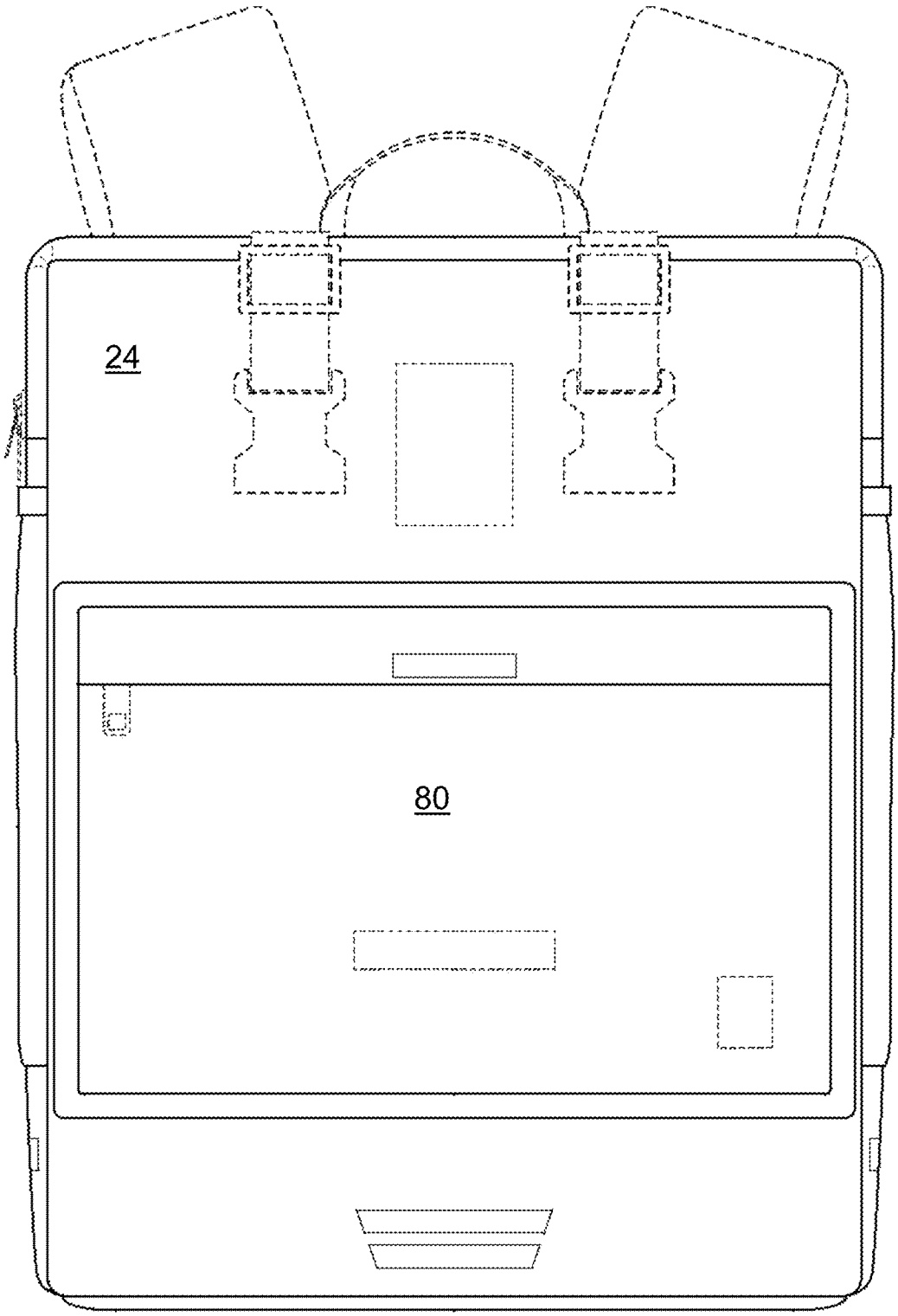
FIG. 38 is a rear view of the backpack and handbag of FIG. 35.
Figure 39:
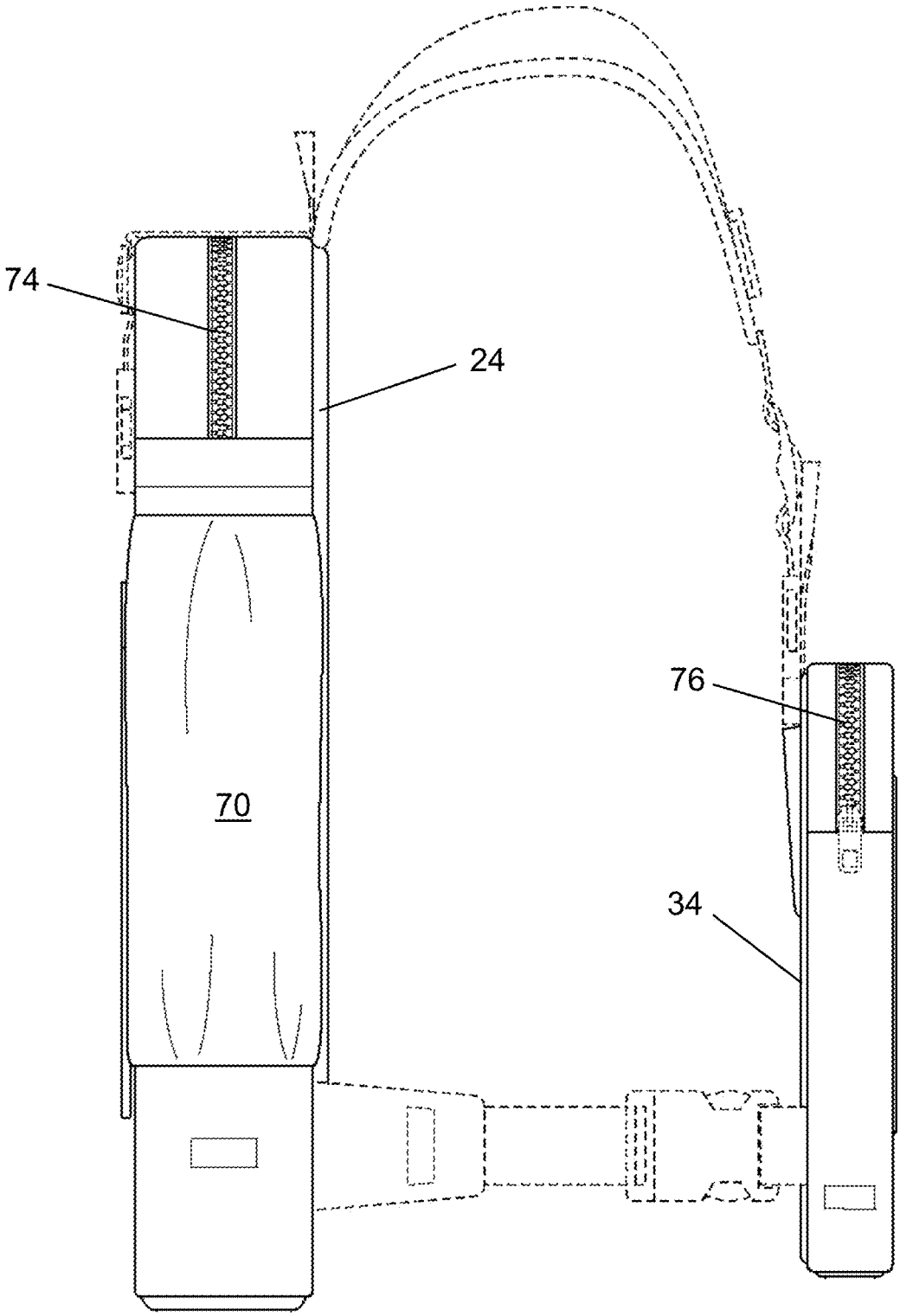
FIG. 39 is a left view of the backpack and handbag of FIG. 35.
Figure 40:
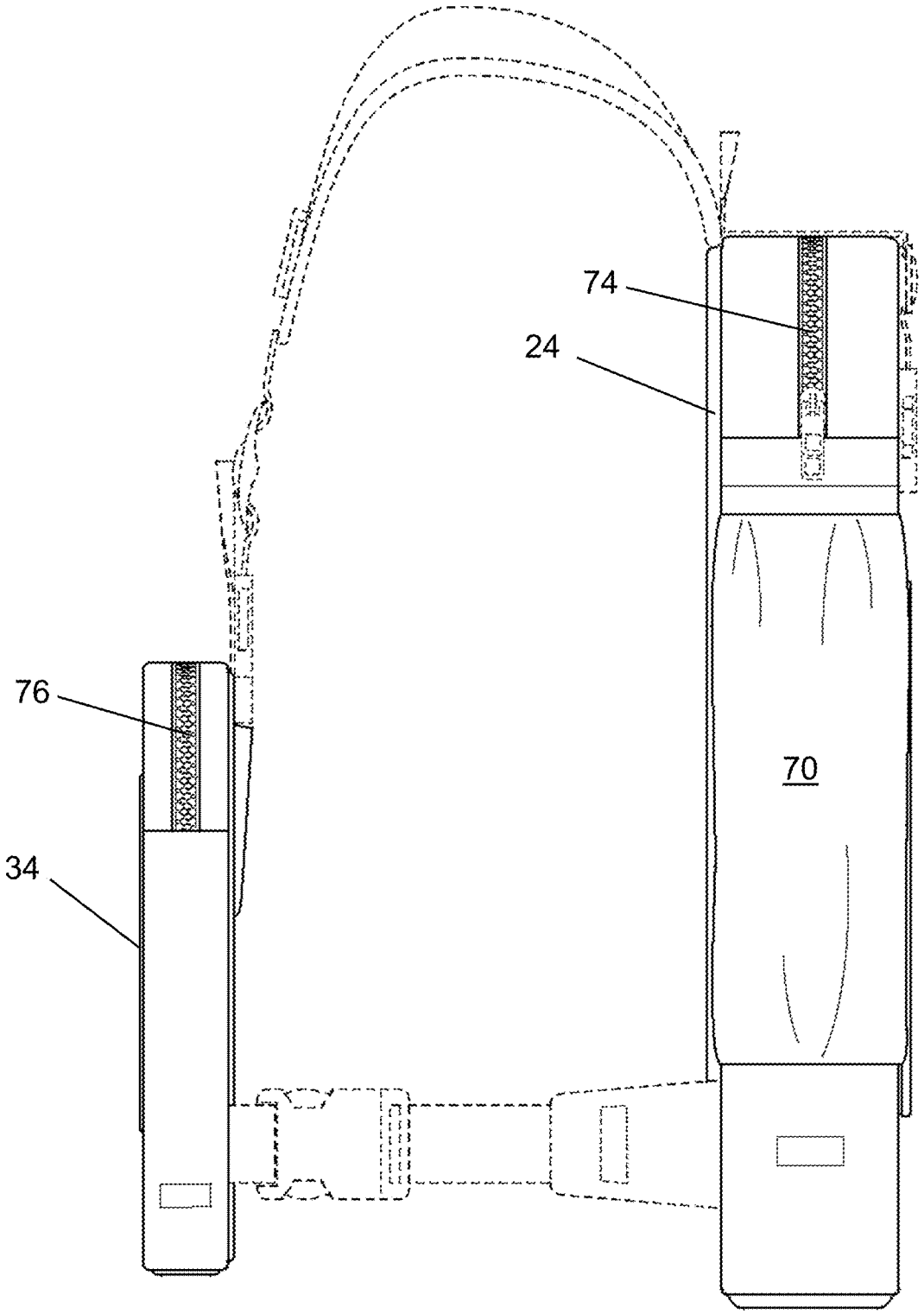
FIG. 40 is a right view of the backpack and handbag of FIG. 35.
Figure 41:
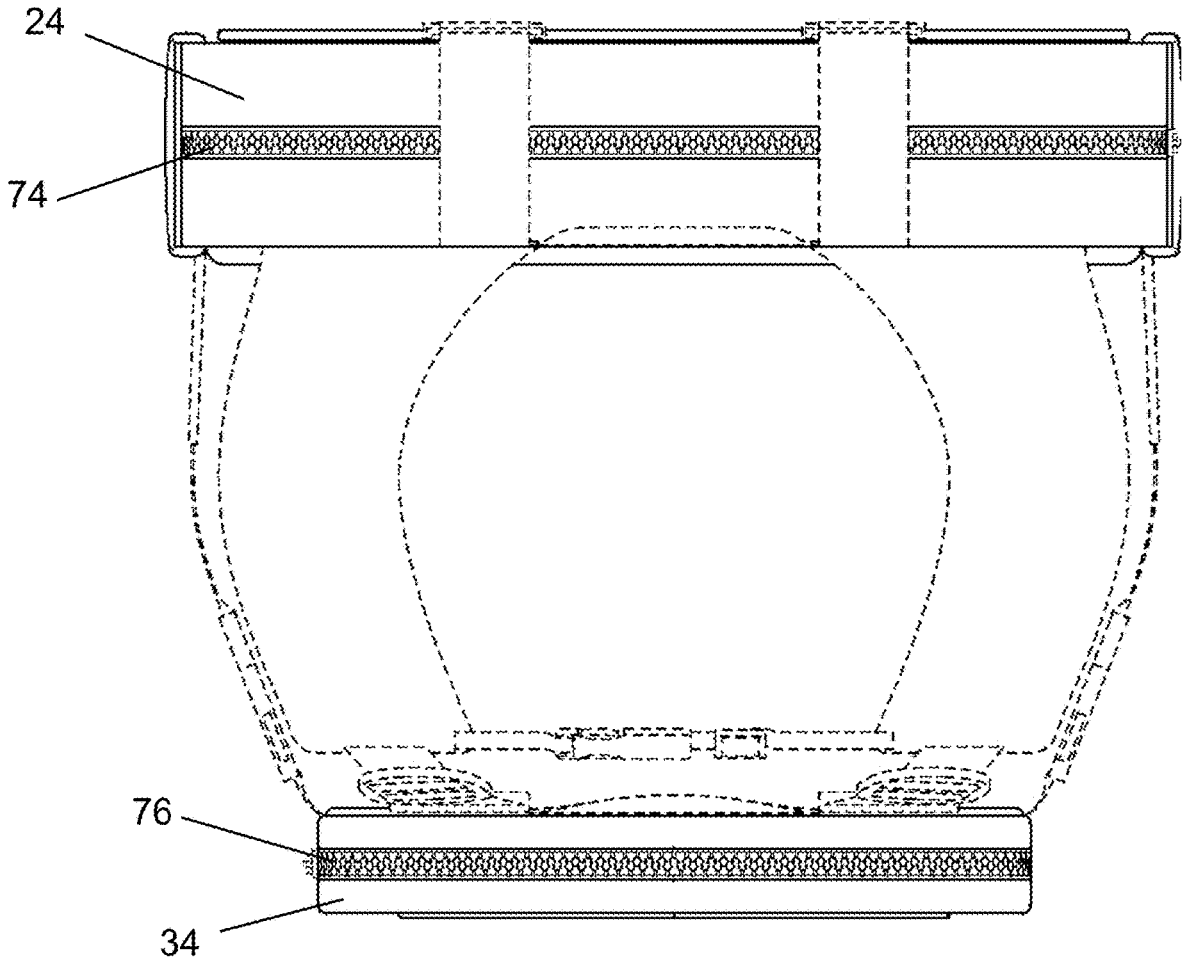
FIG. 41 is a top view of the backpack and handbag of FIG. 35.
Figure 42:
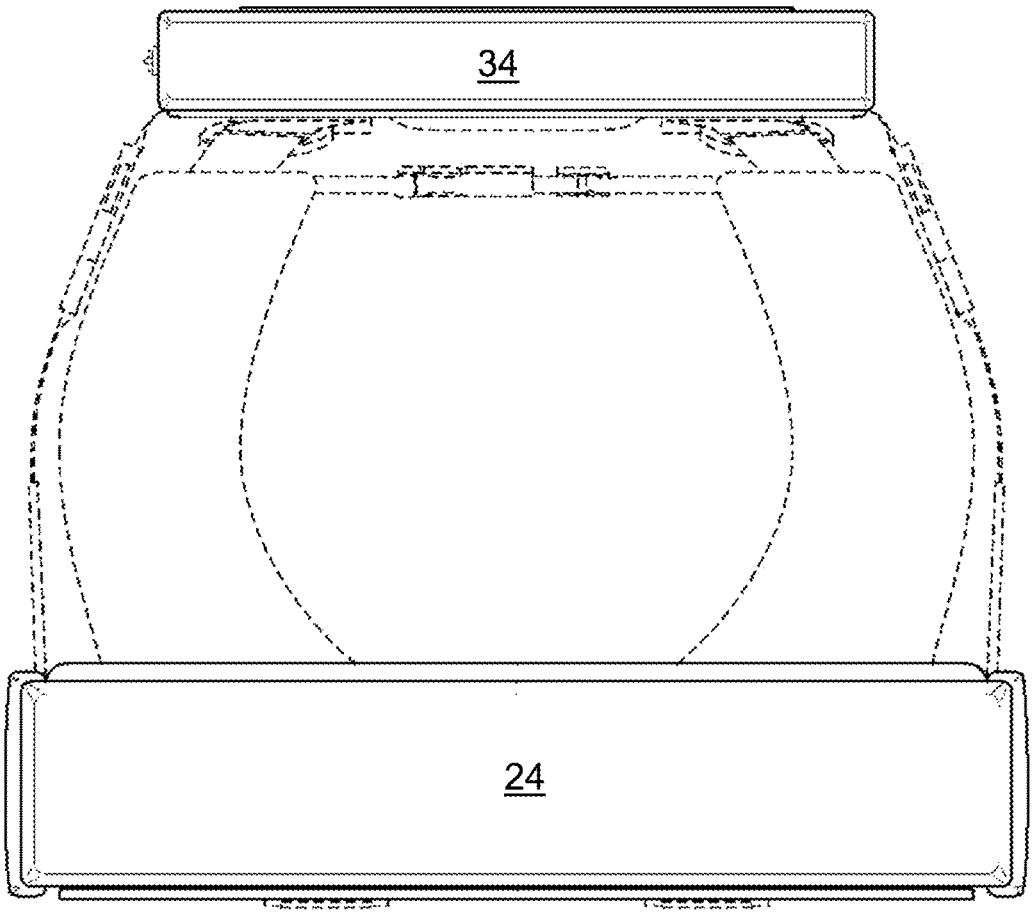
FIG. 42 is a bottom view of the backpack and handbag of FIG. 35.
Figure 43:
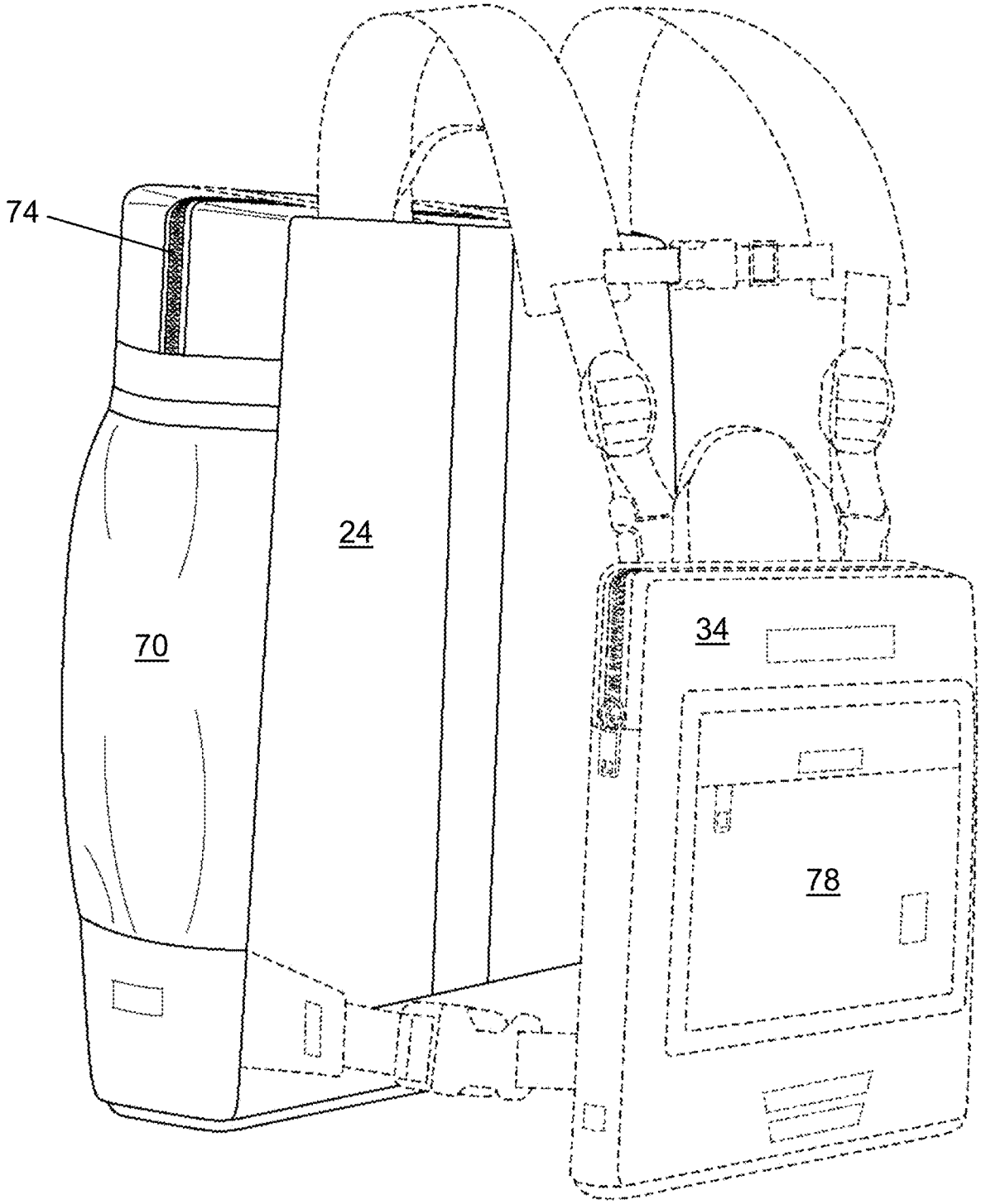
FIG. 43 is another front-left perspective view of the backpack and handbag of FIG. 35.
Figure 44:
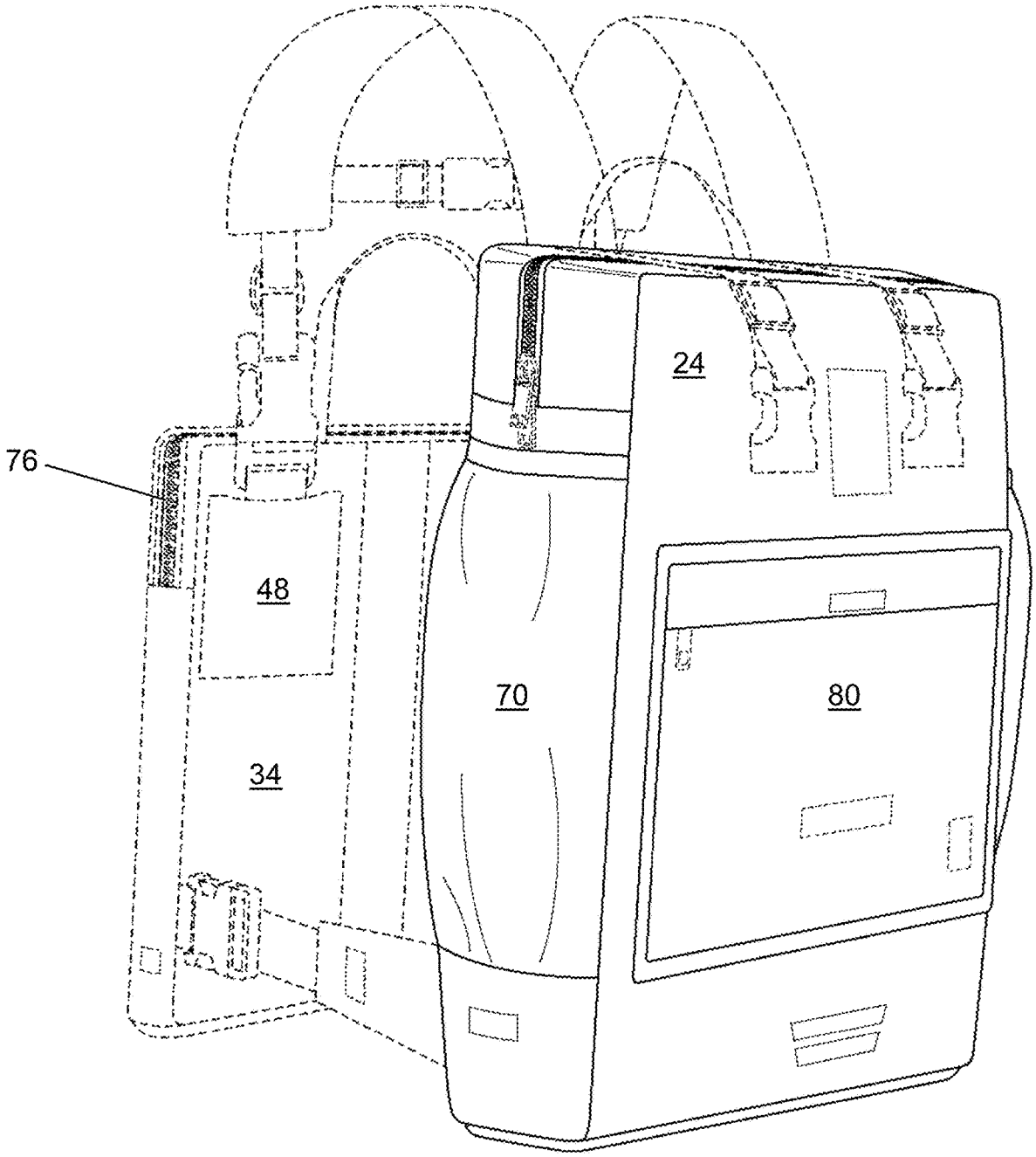
FIG. 44 is another rear-right perspective view of the backpack and handbag of FIG. 35.
Figure 45:
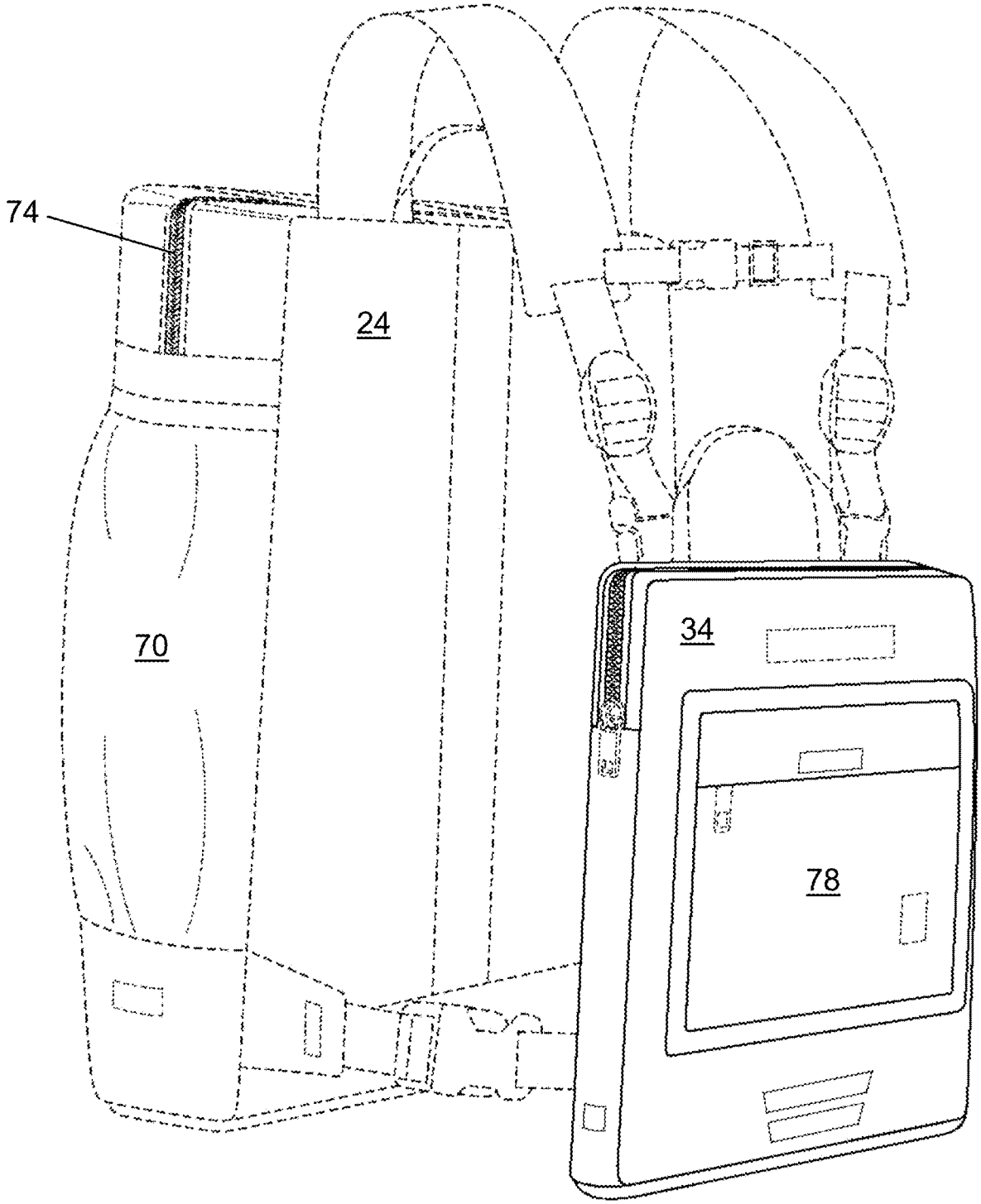
FIG. 45 is another front-left perspective view of the backpack and handbag of FIG. 35.
Figure 46:
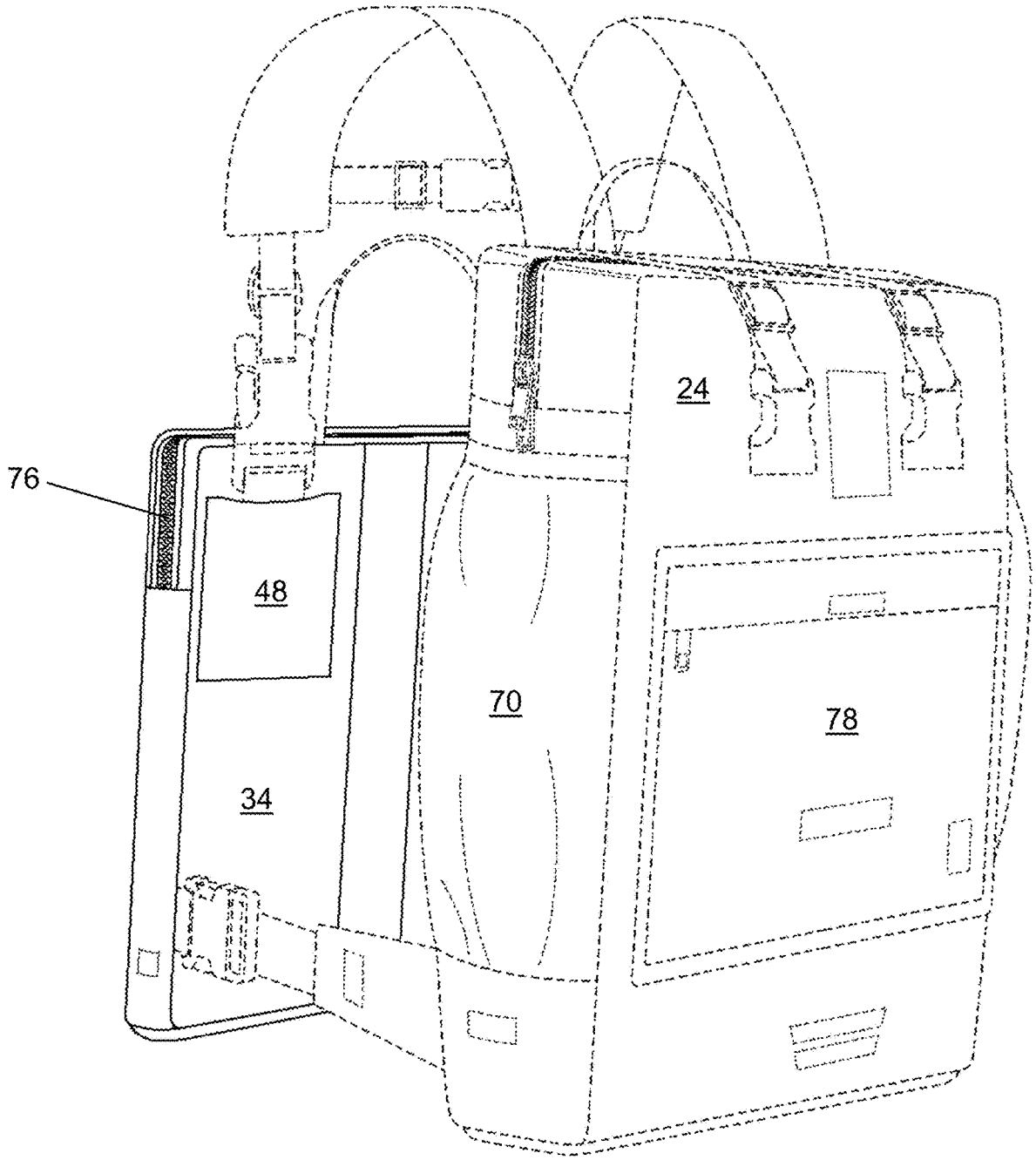
FIG. 46 is another rear-right perspective view of the backpack and handbag of FIG. 35.
Figure 47:
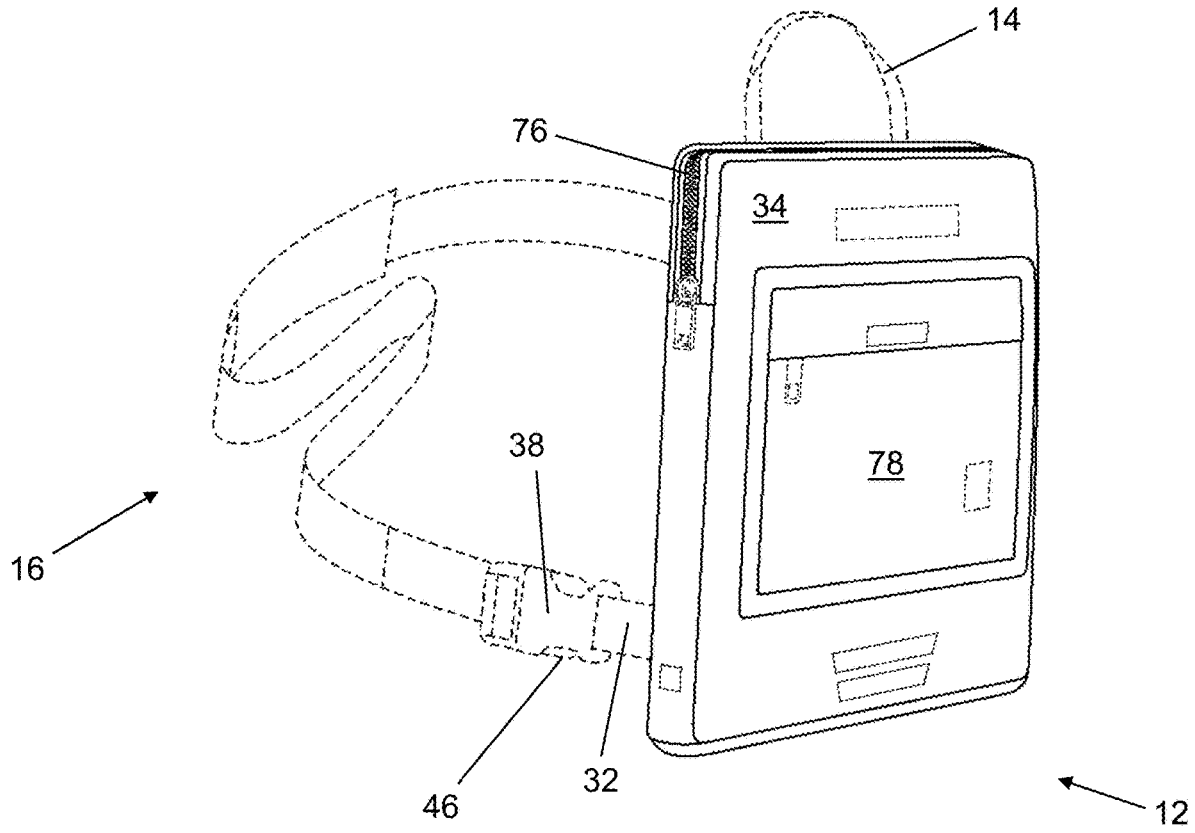
FIG. 47 is a front-left perspective view of the shoulder bag strap and handbag of the modular wearable system of FIG. 17 showing additional details of each.
Figure 48:
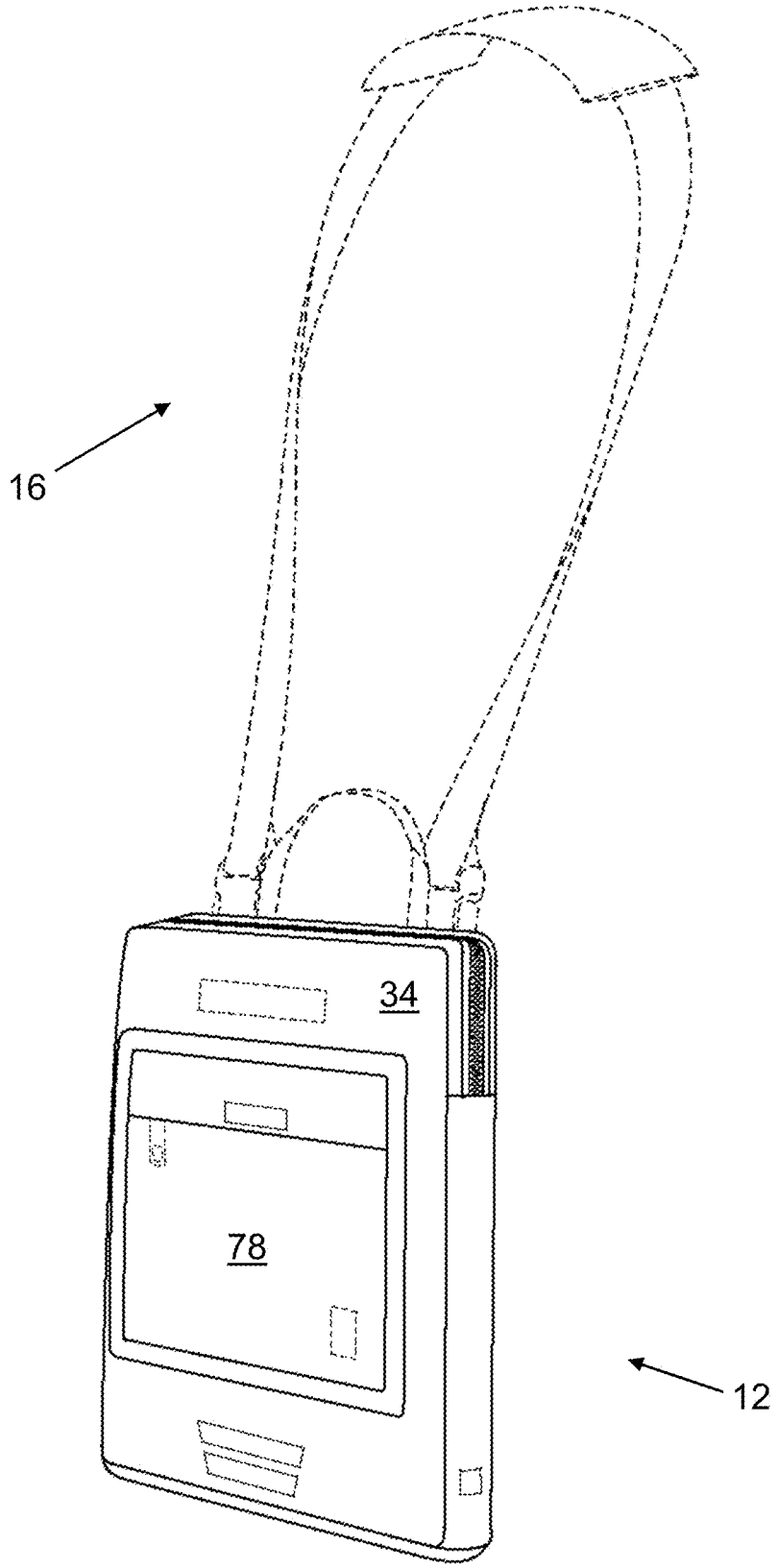
FIG. 48 is a front-right perspective view of the shoulder bag strap and handbag of FIG. 47 in a third configuration of the modular wearable system.

FIG. 34 shows the backpack 18 separated from the handbag 12. When separated from the handbag 12, the backpack 18 can be worn alone by reversibly coupling the shoulder fasteners 26 to the torso fasteners 28 of the backpack 18. In some embodiments, the backpack 18 further includes a chest fastener 42 on a chest strap 44 on each of the shoulder straps 20, as best seen in FIG. 37, that reversibly couple to each other across the chest for added comfort and security when wearing the backpack 18 alone.

When detached from the backpack 18, the handbag 12 can be carried alone by the handle 14 or, when reversibly attached to the shoulder bag strap 16 as shown in FIGS. 17, 34, and 47-48, the handbag 12 can be worn as a shoulder bag with the shoulder bag strap 16 extending over the shoulder, as a waist bag or fanny pack with the shoulder bag strap 16 extending around the waist, or as a messenger bag with the shoulder bag strap 16 extending over the shoulder and across the torso. The shoulder bag strap 16 is adjustable in length and includes strap fasteners 46 on each end of the adjustable strap that reversible couple to the shoulder fasteners 36 and/or the torso fasteners 38 of the handbag 12. In some embodiments, the shoulder fasteners 36 and/or the torso fasteners 38 recede or tuck into pockets 48 in the handbag body 34 and out of sight when not in use. In some embodiments, the modular wearable system includes a separate waist strap specifically for carrying the handbag 12 around the waist.

FIG. 49 shows an alternative wearable configuration of the backpack 18 and handbag 12. In this configuration, both the backpack body 24 and the handbag body 34 are worn on the back. The shoulder fasteners 36 of the handbag 12 are reversibly coupled to complementary carry fasteners 50 on carry straps 52 extending from the top of the backpack body 24 such that the handbag body 34 hangs behind the backpack body 24.

FIGS. 51-62 show a vest 10 of a modular wearable system. The vest 10 includes two shoulder straps 54 and two torso straps 56 that extend from the vest body 58. Each shoulder strap 54 may be adjustable in length and includes a shoulder fastener 60. Each torso strap 56 may be adjustable in length and includes a torso fastener 62 complementary to the shoulder fasteners 60. The vest body 58 is relatively flat in comparison to the backpack body 24 and the handbag body 34 and may only include a pouch 64 for carrying or storing items. In some embodiments, the shoulder straps 54 include a shoulder portion 66 that may be wider and/or padded for added user comfort.

The vest 10 may be worn in a similar manner to the backpack 18 with the vest body 58 on the back of the user and the shoulder straps 54 resting on the shoulders of the user. As shown in FIGS. 51-58, the vest 10 may be worn alone by reversibly coupling the shoulder fasteners 60 to the complementary torso fasteners 62 of the vest 10. Alternatively, as shown in FIGS. 59-62, the vest 10 may be worn in combination with the handbag 12 in a manner similar to the backpack 18 being worn in combination with the handbag 12. This configuration of the vest 10 and handbag 12 can be worn around the torso of a user, with the vest body 58 on the back of the user, the handbag body 34 on the front of the torso of the user, and the shoulder straps 54 resting on the shoulders of the user.

The vest body 58 is more lightweight than the backpack body 24 and thus may be preferable for a user to wear during a more active time, such as, for example, while running, jogging, or on a long walk.

In some embodiments, a sufficient portion of one or more components is formed of a transparent material for viewing the entire contents contained in the component without opening the component, particularly advantageous, for example, for use as a stadium bag when entry of non-transparent conventional bags into a secured area is prohibited.

In some embodiments, a sufficient portion of the backpack body 24 is formed of a transparent material for viewing the entire contents contained in the backpack body 24 without opening the backpack body 24. In some embodiments, the modular wearable system includes both a backpack 20 with a transparent backpack body 24 and a backpack 20 with a non-transparent/opaque backpack body 24 for added versatility.

In some embodiments, a sufficient portion of the handbag body 34 is formed of a transparent material for viewing the entire contents contained in the handbag body 34 without opening the handbag body 34. In some embodiments, the modular wearable system includes both a handbag 12 with a transparent handbag body 34 and a handbag 12 with a non-transparent/opaque backpack body 24 for added versatility.

In some embodiments, a sufficient portion of the vest body 58 is formed of a transparent material for viewing the entire contents contained in the vest body 58 without opening the vest body 58. In some embodiments, the modular wearable system includes both a vest 10 with a transparent vest body 58 and a vest 10 with a non-transparent/opaque vest body 58 for added versatility.

Transparent versions of the vest 10, handbag 12, and backpack 18 may be thinner and more lightweight than the non-transparent/opaque versions or may be sized to meet certain size standards for transparent bags entering a secured area.

The backpack 18, the handbag 12, and/or the vest 10 may have one or more features to aid in the functionality, usefulness, and/or safety of the component and/or of the modular wearable system.

Figure 35:
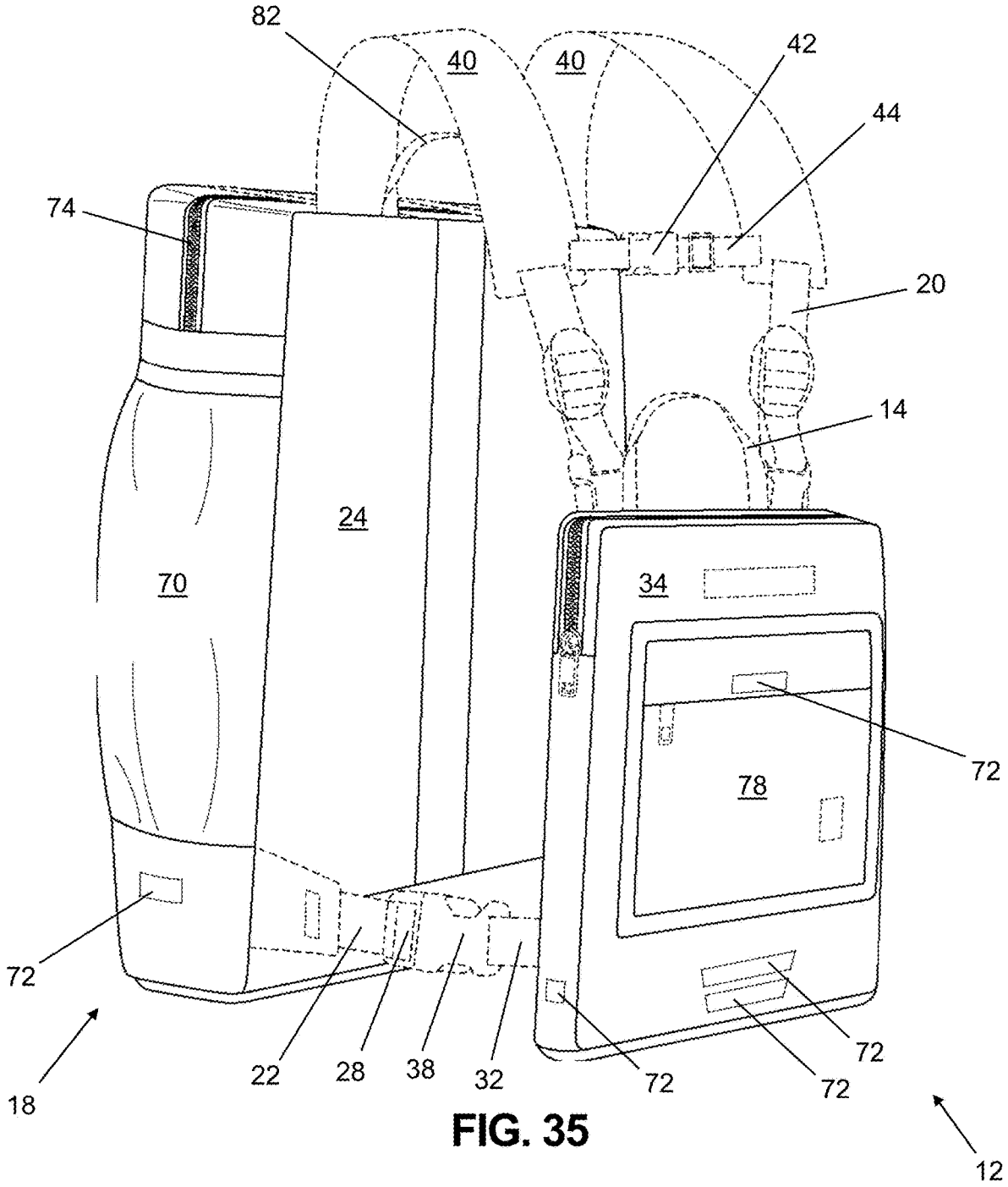
FIG. 35 is a front-left perspective view of the backpack and handbag of the modular wearable system of FIG. 1 showing additional details of each.
Figure 36:
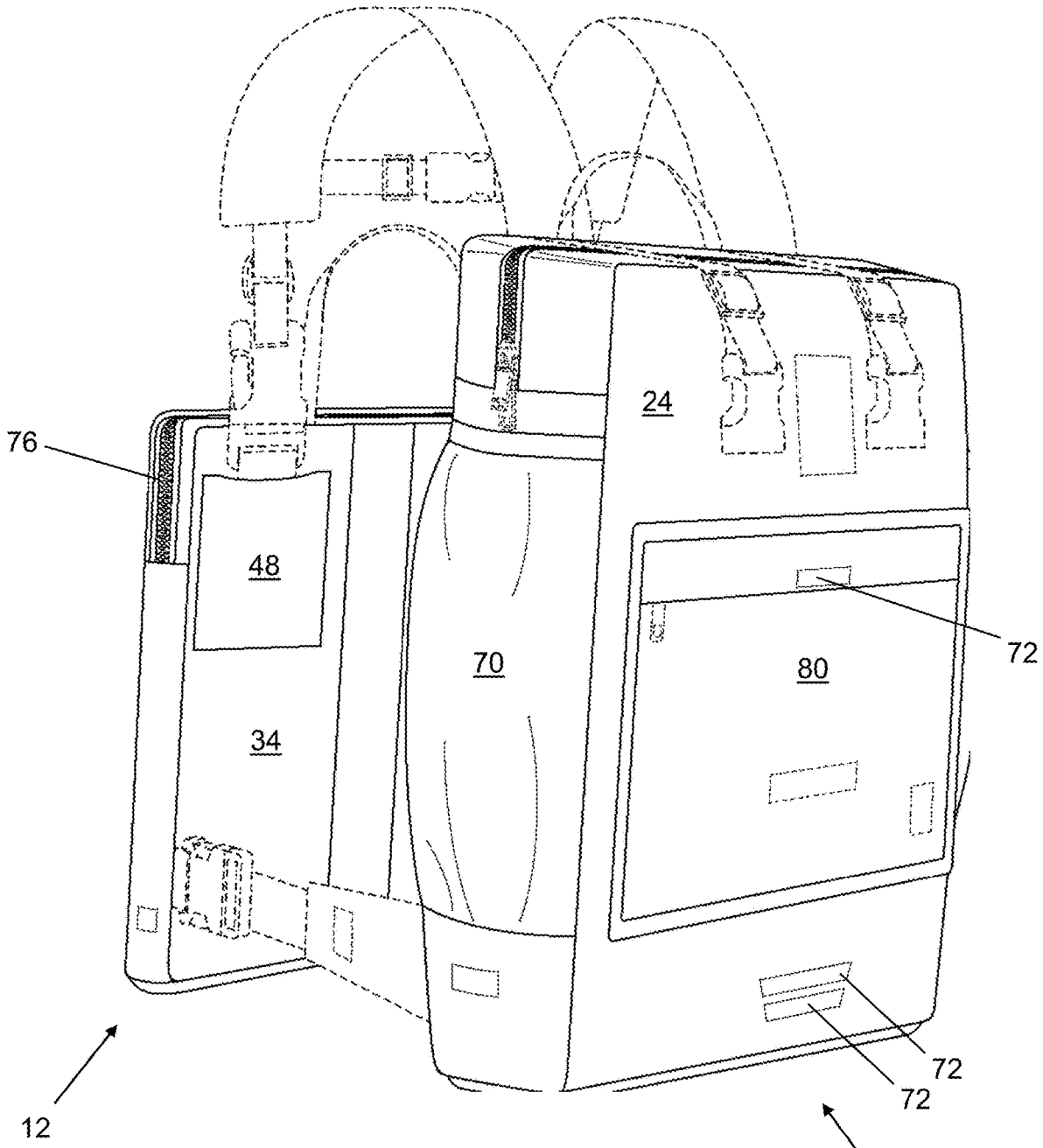
FIG. 36 is a rear-right perspective view of the backpack and handbag of FIG. 35.

For example, one or more components of the modular wearable system may include one or more bottle holders 70 as seen, for example, in FIGS. 35-36, one or more nozzle straps, reflective material 72 on one or more areas of the outer surface of one or more of the components for greater visibility when worn at night, comfortable padding, such as, for example, on the shoulder portions 40 of the backpack 18, a water-repellent exterior, and/or adjustable shoulder straps and/or torso straps.

The backpack body 24, the handbag body 34, and/or the vest body 58 may be sized, shaped, and/or designed to aid in carrying out one or more specific functions and may include one or more nozzle straps, one or more pockets, one or more pouches, and/or one or more reversibly fastenable enclosures or compartments, such as the zipper 74 on the backpack body 24 and the zipper 76 on the handbag body 34 in FIGS. 35-36. FIG. 35 shows a pouch 78 on the handbag body 34. FIG. 36 shows a pouch 80 on the backpack body 24. The backpack body 24 may also have a permanent handle 82, similar to the handle 14 on the handbag body 12, as shown in FIGS. 1-6, 9-12, 14, 18-23, 26-31, 34-40, 43-46, and 49.

In some embodiments, the modular wearable system is a modular wearable tech gear system including one or more tech features. Appropriate tech features may include, but are not limited to, a pouch or enclosure sized to fit a laptop computer, a pouch or enclosure sized to fit a cell phone/smartphone, a pouch or enclosure sized to fit a portable charger, wiring to connect a portable charger in the portable charger pouch or enclosure to a laptop in the laptop pouch or enclosure or to a cell phone/smartphone in the cell phone/smartphone pouch or enclosure. Such wiring may be routed through one or more sleeves on the backpack body 24, the handbag body 34, and/or the vest body 58.

Although the shoulder fasteners 26, 36, 60, torso fasteners 28, 38, 62, strap fasteners 46, carry fasteners 50, and chest fasteners 42 are shown as pairs of male/female clips that snap together and then come apart by squeezing, any other reversibly couplable fastener may be used instead. Other appropriate fasteners may include, but are not limited to, snaps, buckles, zippers, and/or hook-and-loop fasteners.

In a first arrangement, the handbag fasteners reversibly couple to the backpack fasteners to attach the handbag to the backpack such that the handbag is worn on the front of the torso and the backpack is worn on the back as a single unit.

In a second arrangement, the backpack is worn without being attached to the handbag, and the handbag is reversibly attached to a removable adjustable strap that allows it to be worn as a shoulder bag.

In a third arrangement, the handbag is carried as a waist bag with the attached removable adjustable strap going around the waist.

In a third arrangement, the handbag is carried by hand by a permanent handle on the handbag.

In a fifth arrangement, the handbag reversibly attaches to the backpack to hang off the backpack body in the back.

In a sixth arrangement, a vest with a pouch is attached over the shoulder and around the torso.

In a seventh arrangement, the handbag fasteners reversibly couple to the vest fasteners to attach the handbag to the vest such that the handbag is worn on the front of the torso and the vest is worn on the back as a single unit.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A modular wearable system comprising:

(a) a backpack, a handbag, an elongate adjustable handbag strap, and a plurality of fasteners suitable for reversible interconnection to reversibly couple various combinations of the backpack, the handbag, and the elongate adjustable handbag strap;

(b) the backpack comprising:

(i) a backpack body;

(ii) a first pair of backpack straps configured as shoulder straps extending from a top of the backpack body, each of the first pair of backpack straps comprising at least one fastener;

(iii) a second pair of backpack straps configured as torso straps extending from bottom corners of the backpack body, each of the second pair of backpack straps comprising at least one fastener;

(iv) a third pair of backpack straps extending from top edges of the backpack body, each of the third pair of backpack straps comprising at least one fastener;

(c) the handbag comprising:

(i) a handbag body and a handle extending from the handbag body;

(ii) a first pair of handbag straps extending from a top back side of the handbag body, each of first pair of handbag straps comprising at least one fastener; and (iii) a second pair of handbag straps configured as torso straps extending from bottom corners of the handbag body, each of the second pair of handbag straps comprising at least one fastener;

(d) the elongate adjustable handbag strap comprising:

(i) at least one fastener at each of a first end and a second end of the elongate adjustable handbag strap;

wherein the system provides multiple wearable combinations, including:

(i) a first wearable combination wherein the first and second pairs of backpack straps are reversibly coupled via their fasteners to the fasteners of the first and second pairs of handbag straps to securely attach the handbag body to the backpack body such that, when donned by a user, the handbag is wearable on the front of the user's torso and the backpack is wearable on the back of the user's torso;

(ii) a second wearable combination wherein the first and second pairs of backpack straps are reversibly coupled via their fasteners to loop around a user's shoulders, and the fasteners on the first pair of handbag straps are reversibly coupled to the fasteners on the third pair of backpack straps such that the handbag hangs from the backpack body;

iii) a third wearable combination wherein the handbag body and the elongate adjustable handbag strap are reversibly coupled via their fasteners to the first pair of handbag straps to provide a shoulder bag configuration;

(iv) a fourth wearable combination wherein the handbag body and the elongate adjustable handbag strap are reversibly coupled via their fasteners to the second pair of handbag straps to provide a pack wearable around a waist of the user.

2. The modular wearable system of claim 1, wherein a portion of the backpack body is formed of a transparent material for viewing an interior portion of the backpack body without opening the backpack body.

3. The modular wearable system of claim 1, wherein a portion of the handbag body is formed of a transparent material for viewing an interior portion in the handbag body without opening the handbag body.

4. The modular wearable system of claim 1, wherein the handbag comprises backside pockets into which the first handbag fasteners, the second handbag fasteners, or a combination of the first and second handbag fasteners may be tucked when not in use.

5. The modular wearable system of claim 1, wherein the fasteners are selected from the group consisting of mating male and female clips that snap together and then come apart by squeezing, snaps, buckles, zippers, and hook-and-loop fasteners.

6. The modular wearable system of claim 1, wherein the fasteners comprise mating male and female clips that snap together and then come apart by squeezing.

7. A modular wearable system comprising:

(a) a backpack, a handbag, an elongate adjustable handbag strap, a vest and a plurality of fasteners suitable for reversible interconnection to reversibly couple various combinations of the backpack, the handbag, the elongate adjustable handbag strap, and the vest;

(b) the backpack comprising:

(i) a backpack body:

(ii) a first pair of backpack straps configured as shoulder straps extending from a top of the backpack body, each of the first pair of backpack straps comprising at least one fastener;

(iii) a second pair of backpack straps configured as torso straps extending from bottom corners of the backpack body, each of the second pair of backpack straps comprising at least one fastener;

(iv) a third pair of backpack straps extending from top edges of the backpack body, each of the third pair of backpack straps comprising at least one fastener;

(c) the handbag comprising:
(i) a handbag body:
(ii) a first pair of handbag straps configured as shoulder straps extending from a top back side of the handbag body and comprising at least one fastener;
(iii) a second pair of handbag straps configured as torso straps extending from bottom corners of the handbag body, each of the second pair of handbag straps comprising at least one fastener;
(d) the elongate adjustable handbag strap comprising:
(i) at least one fastener at each of a first end and a second end;
(e) the vest comprising:
(i) a vest body comprising a pouch, and free of any fasteners suitable for reversible connection with other fasteners of the modular wearable system;
(ii) extending from the vest body a pair of upper straps and a pair of lower straps, each of which straps includes at least one fastener;
wherein the system provides six possible wearable combinations, including:
(i) a first wearable combination wherein the first and second pairs of backpack straps are reversibly coupled via their fasteners to the fasteners of the first and second pairs of handbag straps to securely attach the handbag body to the backpack body such that, when donned by a user, the handbag is wearable on the front of the user's torso and the backpack is wearable on the back of the user's torso;
(ii) a second wearable combination wherein the first and second pairs of backpack straps are reversibly coupled via their fasteners to loop around a user's shoulders, and the fasteners on the first pair of handbag straps are reversibly coupled to the fasteners on the third pair of backpack straps such that the handbag hangs from the backpack body;
(iii) a third wearable combination wherein the handbag body and the elongate adjustable handbag strap are reversibly coupled via their fasteners to the first pair of handbag straps to provide a shoulder bag configuration;
(iv) a fourth wearable combination wherein the elongate adjustable handbag strap is reversibly coupled to the first pair of handbags straps or the second pair of handbag straps via their fasteners to provide a pack wearable around a waist of the user;
(v) a fifth wearable combination wherein the vest is wearable by reversibly coupling the upper and lower vest straps via their fasteners to loop around the user's shoulders, allowing the vest body to be donned on the front or back of the user's torso;
(vi) a sixth wearable combination wherein the vest is reversibly coupled via the fasteners on the vest straps to the handbag body, allowing the combination, when donned, to be worn with the vest body in front or back of the user's torso and correspondingly allowing the handbag body to be worn opposite the vest body on the front or back of the user's torso.

8. The modular wearable system of claim 7, wherein a portion of the backpack body is formed of a transparent material for viewing an interior portion the backpack body without opening the backpack body.

9. The modular wearable system of claim 7, wherein a portion of the handbag body is formed of a transparent material for viewing an interior portion in the handbag body without opening the backpack body.

10. The modular wearable system of claim 7, wherein a portion of the vest body is formed of a transparent material for viewing an interior portion in the vest body without opening the backpack body.

11. The modular wearable system of claim 7, wherein the pouch of the vest body includes a closure in the form of a zipper.

12. The modular wearable system of claim 7, wherein the fasteners are selected from the group consisting of mating male and female clips that snap together and then come apart by squeezing, snaps, buckles, zippers, and hook-and-loop fasteners.

13. The modular wearable system of claim 7, wherein the fasteners comprise male/female clips that snap together and then come apart by squeezing.

14. A modular wearable system comprising:
(a) a backpack, a handbag, an elongate adjustable handbag strap, a vest, and a plurality of fasteners suitable for reversible interconnection to reversibly couple various combinations of the backpack, the handbag, the elongate adjustable handbag strap, and the vest;
(b) wherein the backpack comprises:
(i) a backpack body;
(ii) a first pair of backpack straps configured as shoulder straps extending from a top of the backpack body, each of the first pair of backpack straps comprising at least one fastener;
(iii) a second pair of backpack straps configured as torso straps extending from bottom corners of the backpack body, each of the second pair of backpack straps comprising at least one fastener;
(iv) a third pair of backpack straps extending from bottom top edges of the backpack body, each of the third pair of backpack straps comprising at least one fastener;
(c) wherein the handbag comprises:
(i) a handbag body;
(ii) a first pair of handbag straps configured as shoulder straps extending from a top back side of the handbag body and comprising at least one fastener;
(iii) a second pair of handbag straps configured as torso straps extending from bottom corners of the handbag body, each of the second pair of handbag straps comprising at least one fastener;
(iv) backside pockets into which the first handbag fasteners, the second handbag fasteners, or a combination of the first and second handbag fasteners may be tucked when not in use;
(d) wherein the elongate adjustable handbag strap comprises:
(i) at least one fastener at each of a first end and a second end;
(e) wherein the vest comprises:
(i) a vest body and vest straps extending from the vest body, wherein the vest straps include a pair of upper straps and a pair of lower straps, each of which includes at least one fastener, and wherein the vest body includes a pouch and is free of any fasteners suitable for reversible connection with other fasteners of the modular wearable system;
(f) wherein the system provides six possible wearable combinations, including:
(i) a first wearable combination wherein the first and second pairs of backpack straps are reversibly coupled via their fasteners to the fasteners of the first and second pairs of handbag straps to securely attach the handbag body to the backpack body such that, when donned by a user, the handbag is wearable on the front of the user's torso and the backpack is wearable on the back of the user's torso;

(ii) a second wearable combination wherein the first and second pairs of backpack straps are reversibly coupled via their fasteners to loop around a user's shoulders, and the fasteners on the first pair of handbag straps are reversibly coupled to the fasteners on the third pair of backpack straps such that the handbag hangs from the backpack body;

(iii) a third wearable combination wherein the handbag body and the elongate adjustable handbag strap are reversibly coupled via their fasteners to the first pair of handbag straps to provide a shoulder bag configuration;

(iv) a fourth wearable combination wherein the elongate adjustable handbag strap is reversibly coupled to the second pair of handbag straps via their fasteners to provide a pack wearable around a waist of the user;

(v) a fifth wearable combination wherein the vest is wearable by reversibly coupling the upper and lower vest straps via their fasteners to loop around the user's shoulders, allowing the vest body to be donned on the front or back of the user's torso;

(vi) a sixth wearable combination wherein the vest is reversibly coupled via the fasteners on the vest straps to the handbag body, allowing the combination, when donned, to be worn with the vest body in front or back of the user's torso and correspondingly allowing the handbag body to be worn opposite the vest body on the front or back of the user's torso.

15. The modular wearable system of claim 14, wherein the fasteners are selected from the group consisting of mating male and female clips that snap together and then come apart by squeezing, snaps, buckles, zippers, and hook-and-loop fasteners.

16. The modular wearable system of claim 14, wherein the fasteners comprise mating male and female clips that snap together and then come apart by squeezing.

17. The modular wearable system of claim 14, wherein the pouch of the vest body includes a closure in the form of a zipper.

18. The modular wearable system of claim 14, wherein the fasteners are mating male and female clips that snap together and then come apart by squeezing, and wherein the pouch of the vest body includes a closure in the form of a zipper.

* * * * *